US007434298B2

(12) United States Patent
De La Fuente

(10) Patent No.: US 7,434,298 B2
(45) Date of Patent: Oct. 14, 2008

(54) CASKET HAVING AN INTEGRAL IMAGE

(75) Inventor: Jose A. De La Fuente, Reforma 2600, Lomas De Chapultepec, Mexico DF 11000 (MX)

(73) Assignee: Jose A. De La Fuente, Lomas De Chapultepec (MX)

( * ) Notice: Subject to any disclaimer, the term of this patent is extended or adjusted under 35 U.S.C. 154(b) by 41 days.

(21) Appl. No.: 11/608,444

(22) Filed: Dec. 8, 2006

(65) Prior Publication Data

US 2007/0144659 A1 Jun. 28, 2007

Related U.S. Application Data

(63) Continuation-in-part of application No. 11/297,864, filed on Dec. 9, 2005.

(51) Int. Cl.
*A61G 19/00* (2006.01)

(52) U.S. Cl. ..... 27/19

(58) Field of Classification Search ..... 27/19, 27/2; 40/312, 629, 630; 156/245, 285, 322, 156/60; 264/241, 245–247
See application file for complete search history.

(56) References Cited

U.S. PATENT DOCUMENTS

| | | | | |
|---|---|---|---|---|
| 246,241 | A * | 8/1881 | Taylor | 33/562 |
| 1,381,908 | A | 6/1921 | Downer | |
| 1,388,426 | A * | 8/1921 | Greive | 27/2 |
| 2,111,462 | A | 3/1938 | Simpson | |
| 2,231,995 | A * | 2/1941 | Glidden et al. | 428/90 |
| 2,249,283 | A * | 7/1941 | Brady et al. | 27/19 |
| 2,916,797 | A | 12/1959 | McCombs | |
| 3,545,055 | A | 12/1970 | Pare | |
| 3,698,037 | A | 10/1972 | Johnson | |
| 3,823,447 | A | 7/1974 | Johnson | |
| 3,831,230 | A | 8/1974 | Rawlings | |
| 3,879,818 | A | 4/1975 | Rowland | |
| 3,981,054 | A | 9/1976 | Hull et al. | |
| 3,997,948 | A | 12/1976 | Hick et al. | |
| 4,077,096 | A | 3/1978 | Christian | |
| 4,304,031 | A | 12/1981 | Semon et al. | |
| 4,320,562 | A | 3/1982 | Kelley | |
| 4,727,632 | A | 3/1988 | Yearsley | |
| 4,730,370 | A * | 3/1988 | Elder | 27/4 |
| 4,800,631 | A | 1/1989 | Pellman | |
| 4,951,367 | A | 8/1990 | Wolfe | |
| 4,971,646 | A | 11/1990 | Schell et al. | |
| 5,113,786 | A | 5/1992 | Hayslip | |
| 5,121,529 | A | 6/1992 | McClure | |
| 5,201,102 | A | 4/1993 | McClure | |

(Continued)

OTHER PUBLICATIONS

"Coffins to Bear Logos of Baseball Teams," Oct. 18, 2006, http://news.moneycentral.msn.com/provider/providerarticle.asp?Feed=AP&Date=20061018&ID=6115331&GT1=8618.

*Primary Examiner*—William L. Miller
(74) *Attorney, Agent, or Firm*—Chad E. Walter; Colin P. Cahoon; Carstens & Cahoon, LLP

(57) ABSTRACT

The present invention discloses a method for making a casket having an integral image that is incorporated into one or more casket parts. A film having an image is adhered to the exterior of a casket. In one aspect, a lenticular or holographic image can be used. In one aspect, the present invention provides a way to provide a sophisticated, elegant, faux stone finish to a casket.

19 Claims, 21 Drawing Sheets

U.S. PATENT DOCUMENTS 5,222,281 A 6/1993 Guerin
5,261,199 A 11/1993 Schmidt
5,302,204 A 4/1994 Hayslip
5,485,661 A 1/1996 McClure
5,495,648 A 3/1996 Rojdev et al.
5,519,923 A 5/1996 Rojdev et al.
5,568,677 A 10/1996 Tobin
5,606,785 A 3/1997 Shelberg et al.
5,619,785 A 4/1997 Tambussi
5,632,073 A 5/1997 Foye
5,680,682 A 10/1997 Watkins et al.
5,695,415 A * 12/1997 Docherty et al. ..... 473/447
5,701,642 A 12/1997 Order
5,762,785 A 6/1998 Garrigos Ruiz
5,771,550 A * 6/1998 Laphan et al. ..... 27/19
5,887,321 A * 3/1999 Foley, Jr. ..... 27/2
5,966,786 A 10/1999 Bowling
5,974,640 A 11/1999 Vosahlik et al.
5,996,197 A 12/1999 Jurkovic
6,105,221 A 8/2000 Cox
6,154,939 A 12/2000 Woedi
6,223,404 B1 * 5/2001 Fant et al. ..... 27/19
6,301,758 B1 10/2001 Biondo et al.
6,314,626 B1 11/2001 Becker
6,499,193 B1 12/2002 Robert
6,574,841 B1 6/2003 Vosahlik et al.
6,745,442 B2 6/2004 Biondo et al.
7,222,400 B2 * 5/2007 Leverett ..... 27/19

* cited by examiner

CASKET HAVING AN INTEGRAL IMAGE

CROSS-REFERENCE TO RELATED APPLICATION

This is a continuation-in-part of application Ser. No. 11/297,864, filed on Dec. 9, 2005.

FIELD OF THE INVENTION

The present invention generally relates to a modular casket or coffin and more particularly to a modular casket or coffin having an integral image.

BACKGROUND OF THE INVENTION

Caskets or coffins are typically purchased during a stressful time shortly after the unfortunate need arises due to the death of a loved one. Although caskets have been traditionally purchased through a funeral home, caskets could be more available from alternative point of sale locations such as directly from a funeral supply stores, the internet, and retail locations. The available selection of caskets, however, is mostly limited to steel or wood caskets that are expensive. The bulky steel or wood caskets are also difficult to ship and prone to damage during shipment which increases the difficulty of using alternative point of sale locations. Caskets also occupy considerable space when stored and require climate controlled storage. Consequently, a need exists for a less expensive casket. A need also exists for a modular casket that can be easily shipped and assembled and can be stored in a non-climate controlled facility.

Further, the steel or wood caskets typically have a single, mono-tone color. For example, wood caskets often have a wood-looking, brown exterior. Steel caskets often have a single steel-like color such as gray or silver. Application of exterior finishes typically occurs after the casket piece has been manufactured. Consequently, the addition of different designs to a steel or wood casket through application of a stain, primer, paint, lacquer, or other similar coating can be labor-intensive and therefore expensive to apply and such finishes are highly prone to damage during shipment and storage. Further, as the complexity of the design increases, the cost substantially increases. This is one reason that caskets typically have only single-color, monotone exteriors. Consequently, a need exists for a method of making a casket that incorporates one or more pre-made images, such as a color or design, to the casket exterior during or after the manufacturing process.

Prior art attempts have been made to decorate casket exteriors. For example, U.S. Pat. No. 1,388,426 discloses a method of decorating the surface of a casket. The method involves a time-consuming labor-intensive process.

U.S. Pat. No. 6,223,404 discloses a casket with a customized, decorative external surface and methods in which panels of an adhesive-backed substrate material with a digitally imaged design are fixed to the casket surface. This method also requires a time-consuming labor-intensive process including the steps of applying an acid-wash neutralizer to the external surface of the casket, buffing the surface, applying a primer, and finally applying the substrate material. The method also heavily emphasizes the complicated step of supplying a two-dimensional image that can be placed on a three-dimensional casket.

SUMMARY OF THE INVENTION

The proposed invention is directed towards a method of placing of an integral image on one or more modular casket parts. In one aspect, the method comprises placing a film having an image into a mold cavity, injecting the mold cavity with a molten plastic to form a casket part, applying multi-layer film to the casket part, and cooling the casket part such that the image adheres to the casket exterior. The present invention thereby provides a way to place lenticular or holographic images onto a casket. The invention also provides an inexpensive way to provide a high quality finished look such as the look for a faux stone finish to a casket. The above as well as additional features and advantages of the present invention will become apparent in the following written detailed description.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
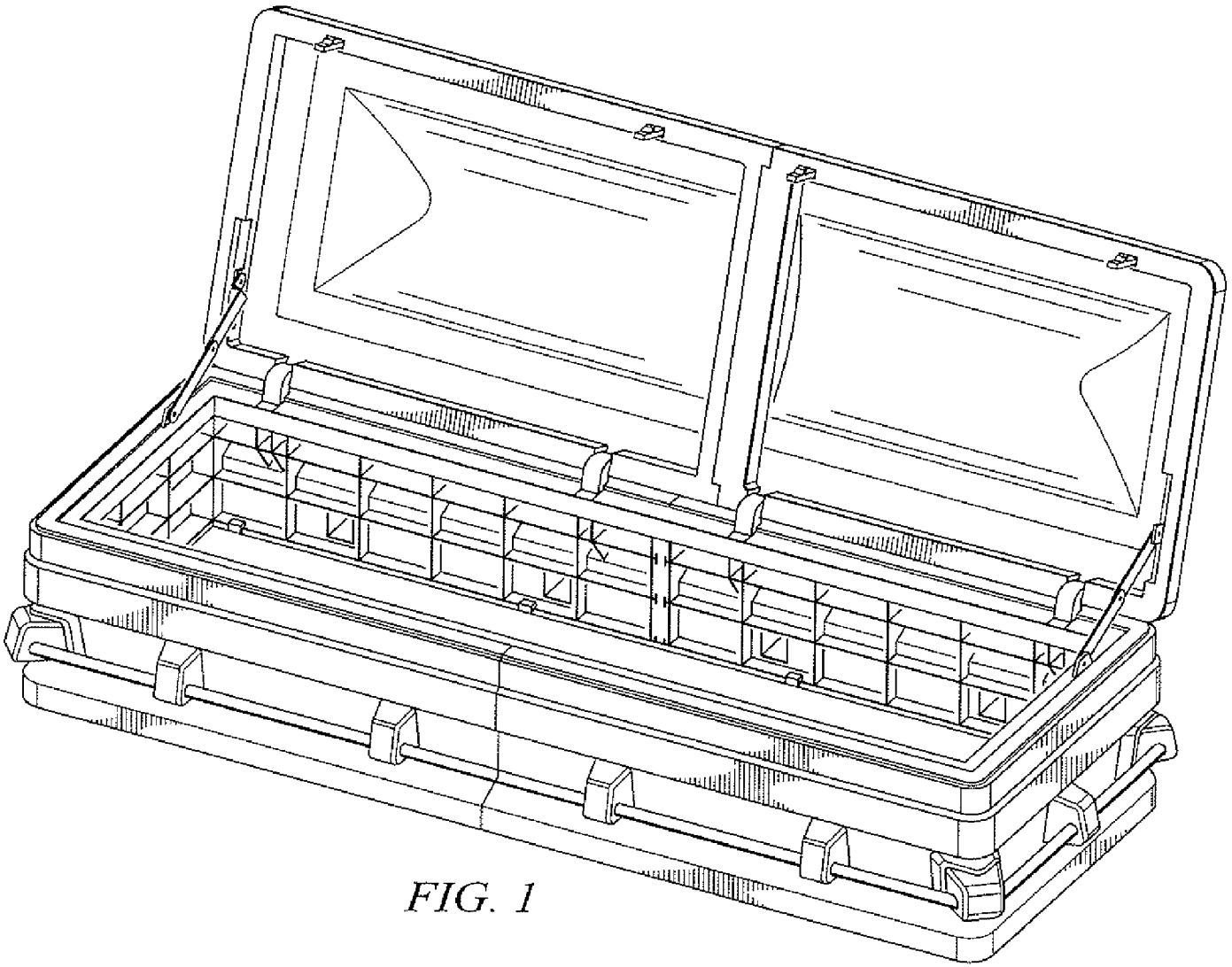
FIG. 1 is a top perspective view of the casket in accordance with one embodiment of the present invention.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

DETAILED DESCRIPTION

Figure 2:
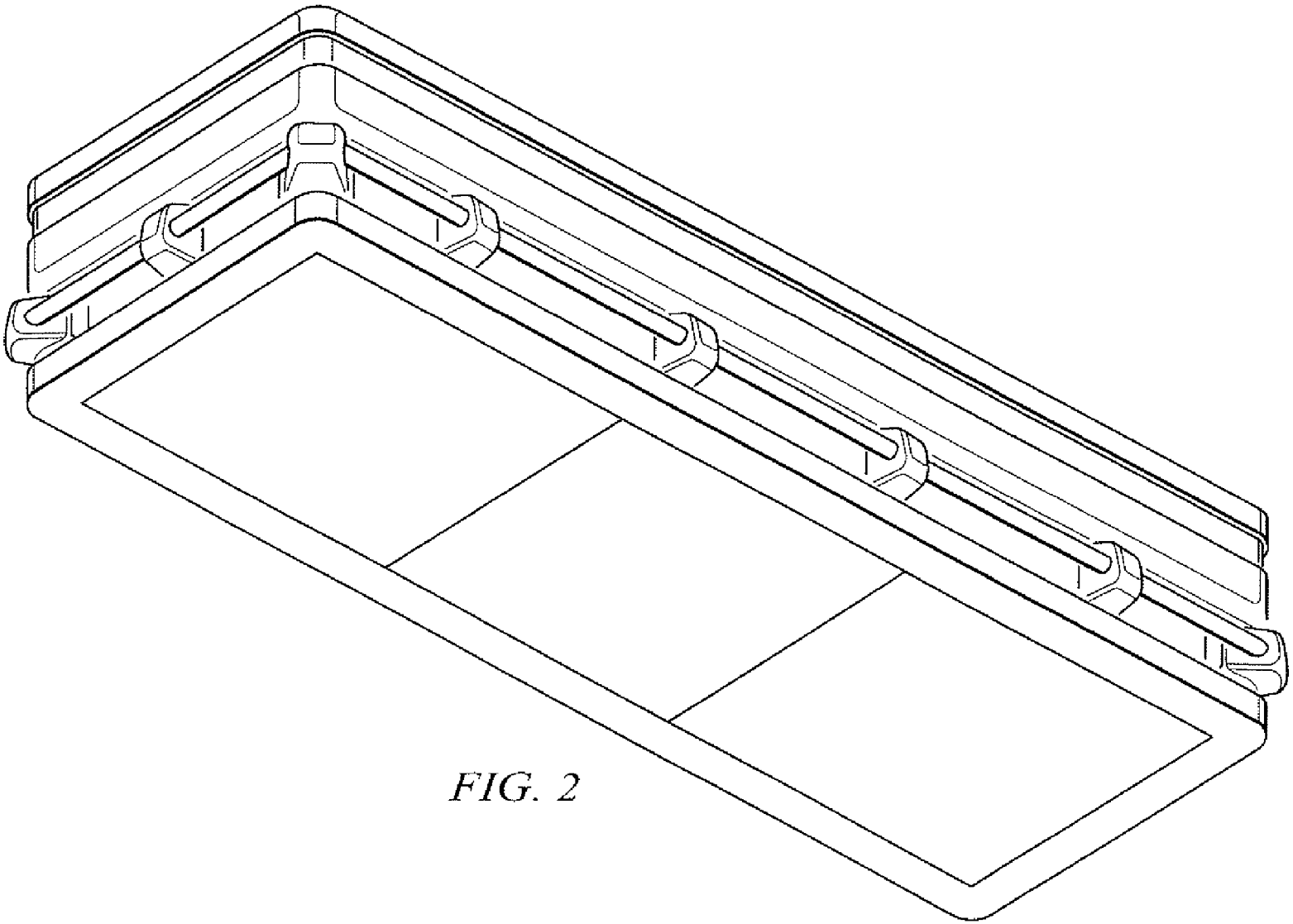
FIG. 2 is a bottom perspective view of the casket in accordance with one embodiment of the present invention.
Figure 3:
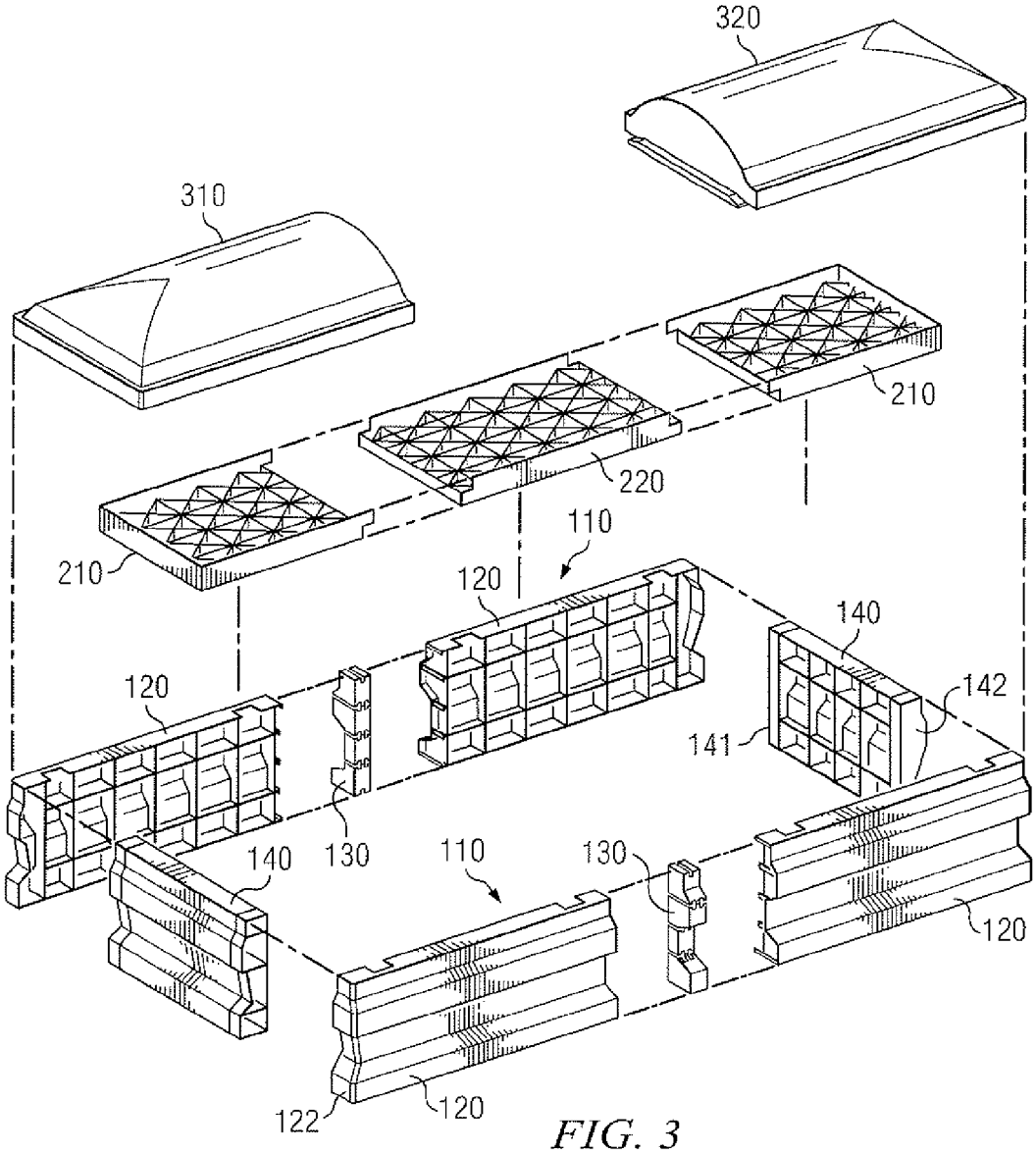
FIG. 3 is an overall exploded perspective view of the casket in accordance with one embodiment of the present invention.

FIG. 1 is a top perspective view of the casket in accordance with one embodiment of the present invention. As used herein, the term "casket" is synonymous with and meant to include the term "coffin." FIG. 2 is a bottom perspective view of the casket in accordance with one embodiment of the present invention. FIG. 3 is an overall exploded perspective view of the casket in accordance with one embodiment of the present invention. Referring to FIG. 3, the casket comprises a pair of opposed sidewalls 110. The same reference numbers are used to identify the same corresponding elements throughout all drawings unless otherwise noted. The sidewalls 110 comprise one or more side panels 120. In one embodiment, each sidewall 110 comprises a pair of side panels 120 slidably connected together by a wedge member 130. Each side panel 120 comprises a vertical side 122 designed to be slidably attached to a vertical end panel side 141 142. It should be pointed out that the "vertical" end panel sides 141 142 do not need to be vertical and such sides can be rounded. The term "vertical" is simply used to denote the side 141 142 of the end panel 140 that is attached to the side panel 120. Similarly, the vertical side 122 of the side panel 120 can be rounded or any other shape and is simply called "vertical" to denote the side 122 of the side panel 120 that is attached to the end panel 140. The base section can comprise one or more pieces. In one embodiment, the base section comprises two base ends 210 and a middle base portion 220. The base section can be attached to the opposed side panels 120 and/or said opposed end panels 140.

The lid can comprise one or more sections. In one embodiment, a first lid section 310 and a second lid section 320 can be attached to the sidewall 110. In one embodiment, the first lid section 310 is attached to a first side panel 120 and the second lid section 320 is attached to an adjacent second side panel 120.

The base section, side walls, end panels, and lid can comprise a plastic composition. Although the base section, side walls, end panels, and lid components and the hinge assembly can be formed from a variety of different materials using different manufacturing techniques, in one embodiment, they are injection molded from a suitable plastic containing fibers for reinforcement. Plastics that can be used include, but are not limited to ABS, polycarbonate, fiberglass, metals, and mixtures thereof Any injection molded composition can be used. As used herein, an "injection molded composition" is defined as any material, resin or composite that can be injection molded. It should be further noted that different additives can be used for different injection molded parts. Strengthening ribs and other complex structures can be provided to make the components more rigid.

As shown in FIG. 3, each side panel 120 comprises one rounded edge near the end panel 140. Such illustration is just one example of how a rounded corner can be provided. In one embodiment (not shown), the end panel comprises one or more rounded corners. In one embodiment (not shown), a side panel comprises a rounded corner. Some consumers deem rounded corners to be desirable in caskets and caskets having rounded corners are more expensive to manufacture and are consequently more expensive in the marketplace. For example, the expenses of making a metal or steel casket with a rounded edge are significant because of the forming/stamping/pressing operation that is required to form the metal or steel material. Such forming equipment is expensive. Consequently, steel and metal caskets are typically cut to length and welded together to form square corners. However, caskets made of sheet metal are still labor intensive because of the welding and grinding that is required in putting the caskets together. Wood caskets more typically have rounded corners, but wood is relatively heavy, bulky, and expensive to ship. Both metal and wood caskets, if not assembled prior to shipment, are difficult to assemble at a point of distribution or use, unlike the present invention, which is easy to assemble for reasons discussed in more detail below.

Figure 4:
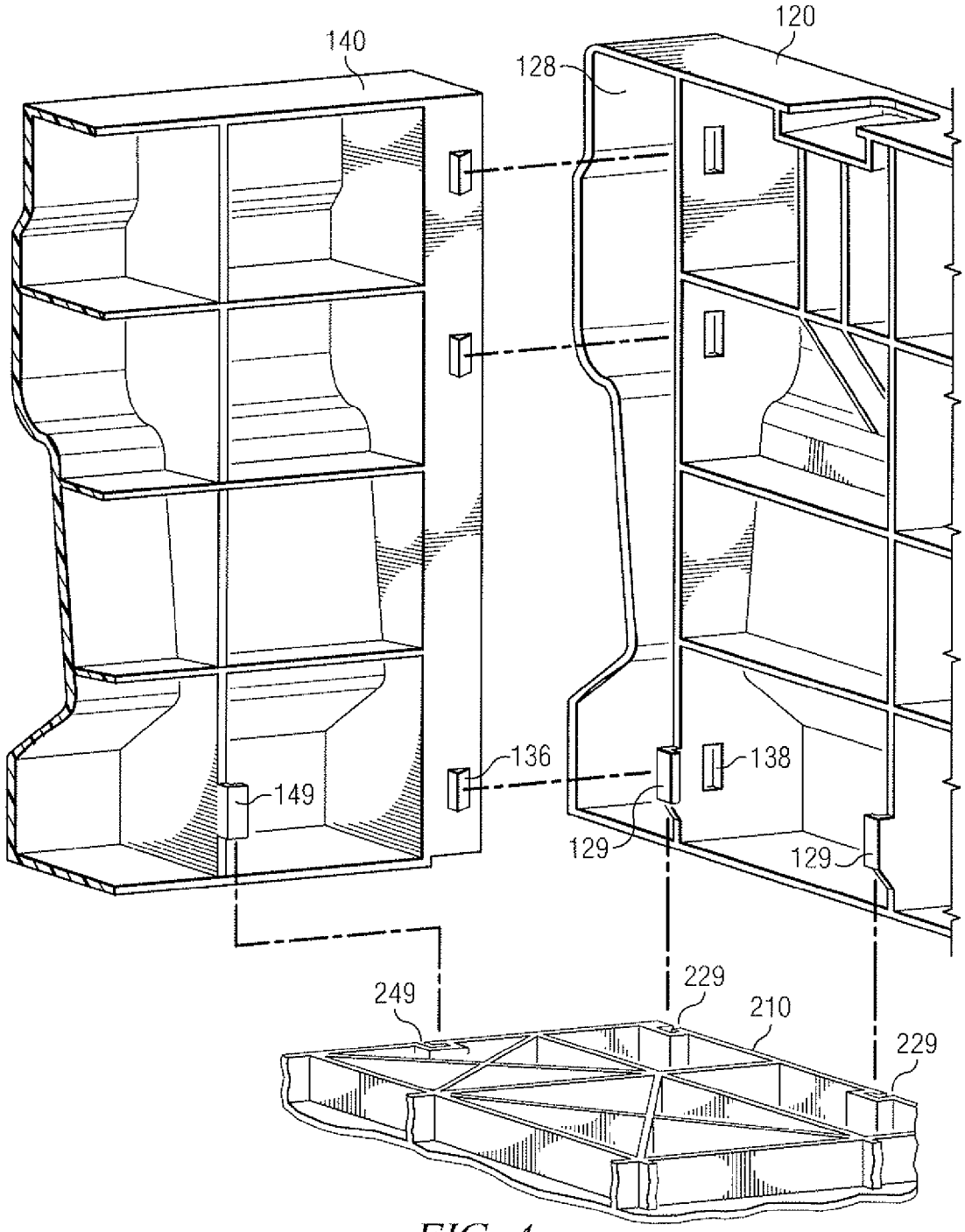
FIG. 4 is a partial cutaway detailed view depicting the connection between a side panel, an end panel, and a base section in accordance with one embodiment of the present invention.

FIG. 4 is a partial cutaway detailed view depicting the connection between a side panel 120, an end panel 140, and a base section 210 in accordance with one embodiment of the present invention. In the embodiment shown, the end panel 140 is sized to be slidably connected into the side panel 120 receiving cavity 128. As used herein the term "slidably connected" and the term "slidably attached" is defined by the attachment or connection of two pieces such that the pieces are pressure-fit together. "Pressure-fit," is a term known to those skilled in the art. The term can refer to a bond caused by mutual pressure acting on the contact surfaces between two parts in contact, wherein the two parts require no weld, screw, or nail connection. Thus, in one embodiment, the side panel 120 and receiving cavity 128 are sized to maximize the contact between the side panel 120 outer periphery and receiving cavity 128 inner periphery. In addition, a male member 136 on the end panel 140 is located so as to snap-fit into a female member 138 located on the side panel 120. Such members 136 138 help to further lock the two pieces together and secure the two pieces in place. Such members not only help hold the two pieces together, but they also further signal the assembler that the connection is complete. It should be pointed out that this specific connection is provided for purposes of illustration and not limitation. There can be any number of male and female pairs in any configuration. For example, in an embodiment not shown, similar male and female members are provided on the base section 210 and end panel 140 to further lock the end panel 140 and base section 210 together and/or signal the assembler that the connection is complete. In one embodiment not shown, similar male and female members are provided on the base section and side panel for similar reasons.

It should also be pointed out that the panels can be designed such that a side panel is sized to be slidably connected to an end panel receiving cavity (not shown). Such embodiment can occur if the end panel 140 is rounded and the side panel 120 is flat at the corner connection.

As shown in FIG. 4, in one embodiment, the base end 210 comprises L-shaped female side panel interlocking members 229 that can slidably connect to an L-shaped male side panel locking member 129. Similarly, the base end 210 comprises an L-shaped female end panel interlocking member 249 that can slidably connect to an L-shaped male end panel locking member 149. It should be pointed out that while the embodiment depicted and discussed with reference to FIG. 4 is directed towards L-shaped slots, any shape (tapered or untapered, L-shaped, T-shaped, etc.), number, and combination (male member on base and female on panel or female on panel and male on base) of interlocking-shaped members that can be used to slidably connect the base section 210 to the side panel 120 and/or end panel 140 does not depart from the spirit and scope of the present invention.

Figure 5A:
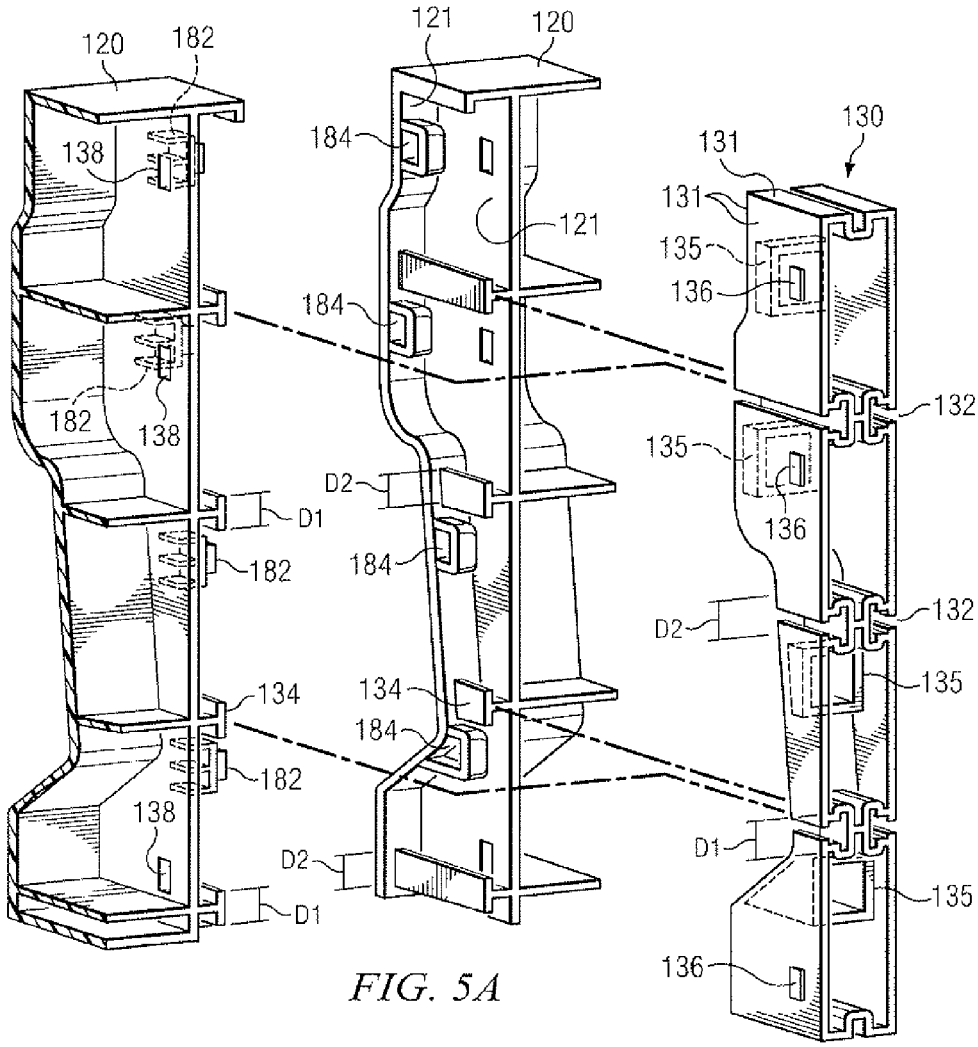
FIG. 5*a* is an exploded perspective side view depicting the connection of two side panels by a wedge member in accordance with one embodiment of the present invention.

FIG. 5*a* is an exploded perspective side view depicting the connection of two side panels 120 by a wedge member 130 in accordance with one embodiment of the present invention. Although the wedge member 130 shown depicts three pair of T-shaped female slots 132, the wedge member 130 can comprise any combination (number, shape, placement of male/female) of interlocking members. In one aspect, an interlocking member is a male member or a female member. Providing interlocking members as an integral part of the side panels, end panels, and base section allows the interlocking in as many places as is required without the need for a separate weld, nail, screw, nut, bolt, or adhesive. In one embodiment, the wedge member 130 comprises one or more female T-shaped slots. Further, the wedge member 130 can comprise one or more pairs of T-shaped male protrusions and/or one or more pairs of T-shaped female slots. Similarly, the side panels 120 can comprise one or more pairs of T-shaped male protrusions or female slots. In one embodiment the T-shaped female slots 132 and T-shaped male protrusions 134 disposed on the side panels 120 are tapered. Thus, in one embodiment, the male T-shaped protrusions 134 comprise a first distance D1 at the inner portion of the side panel 120 and a second, larger distance D2 at the outer portion of the side panel 120. Similarly, in one embodiment, the female T-shaped slots 132 comprise a first distance D1 at the inner portion of the female slot 132 and a second, larger distance D2 at the outer portion of the female slot 132. Of course, the tapering can be reversed resulting in a second, smaller distance D2. The male protrusions 134 and female T-shaped slots 132 slidably connect to adjoin the two side panels 120 in a sturdy fashion. In one embodiment, the wedge 130 and side panel are sized to maximize contact between the outer wedge periphery 131 and a portion of the inner side panel periphery 121. Male 136 and female 138 locking members can be provided to lock the wedge member 130 into place between the two side panels 120.

Although not necessary, in one embodiment, the first side panel 120 comprises a plurality of tapered or non-tapered integral alignment protrusions 182 that can be aligned with a plurality of corresponding tapered or non-tapered alignment slots 184 integral to a second side panel 120. A locking frame 135 on the wedge member 130 can be used to lock the alignment protrusions 182 and alignment slots 184 in place and help absorb any shock loads on the sidewall assembly.

The above-described configuration is beneficial for several reasons. First, the wedge member 130 permits side panels 120 to be fastened together with virtually no tools. At most, a rubber mallet may be required to force the wedge member 130 into place between the two side panels 120. Second, the configuration of the T-shaped protrusions and slots distributes any forces or tension placed on the wall joint over a larger area. Third, because the T-shaped protrusions and slots are oriented parallel to any normal forces exerted on the panels, e.g. forces that are perpendicular to the plane of the side panels, a sturdy connection can be made at the joint between the two side panels 120. Thus, the T-shaped protrusions and slots provide a resistance to forces normal to the side panel connection. Fourth, because the connection is intuitive to the user, the design facilitates assembly. Fifth, because no screws or nails are required, the connection can be made relatively quickly leading to more efficient casket assembly. Further, such connection is superior to nuts, bolts, screws, or nails because the fastening force is distributed over a larger surface area. Sixth, the connection can also be disassembled with few or no tools.

Figure 5B:
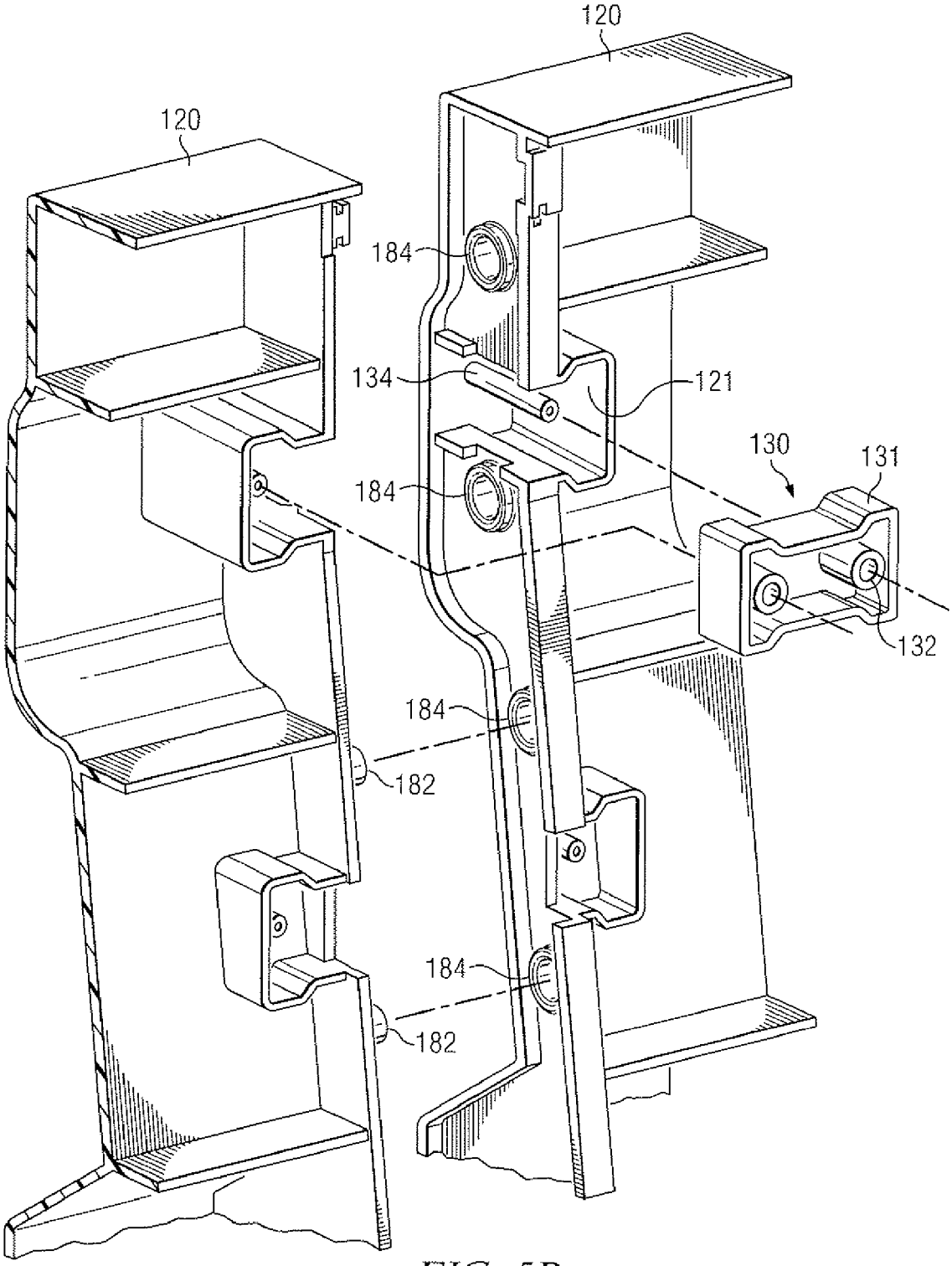
FIG. 5*b* is an exploded perspective side view depicting the connection of two side panels by a wedge member in accordance with an alternative embodiment of the present invention.

While several embodiments discussed above are directed towards T-shaped protrusions and slots, any type and number of tapered or non-tapered interlocking-shaped members can be used to slidably connect two side panels 120 together with a wedge member 130 without departing from the spirit and scope of the present invention. For example, FIG. 5*b* is an exploded perspective side view depicting the connection of two side panels 120 by a wedge member 130 in accordance with an alternative embodiment of the present invention. Referring to FIG. 5*b*, the I-shaped wedge member 130 comprises a hollow cylinder comprising a slot 132 in the center of the hollow cylinder. The side panel 120 comprises a smaller cylindrical protrusion 134 sized such that it can be snugly placed into the slot 132. In one embodiment, the wedge 130 and an integral portion of the inner side panel periphery 121 are sized to maximize contact between the outer wedge periphery 131 and a portion of the inner side panel periphery 121. The protrusion 134 and corresponding slot 132 can be tapered or non-tapered and may have male or female members (not shown) similar to those identified as numerals 136 and 138 in FIG. 4 to help the wedge member snap into place. Further, in one embodiment, another fastening means including but not limited to a wingnut with or without a washer (not shown), cotter pin or other device can be inserted through the protrusion 134 and slot 132.

Figure 5C:
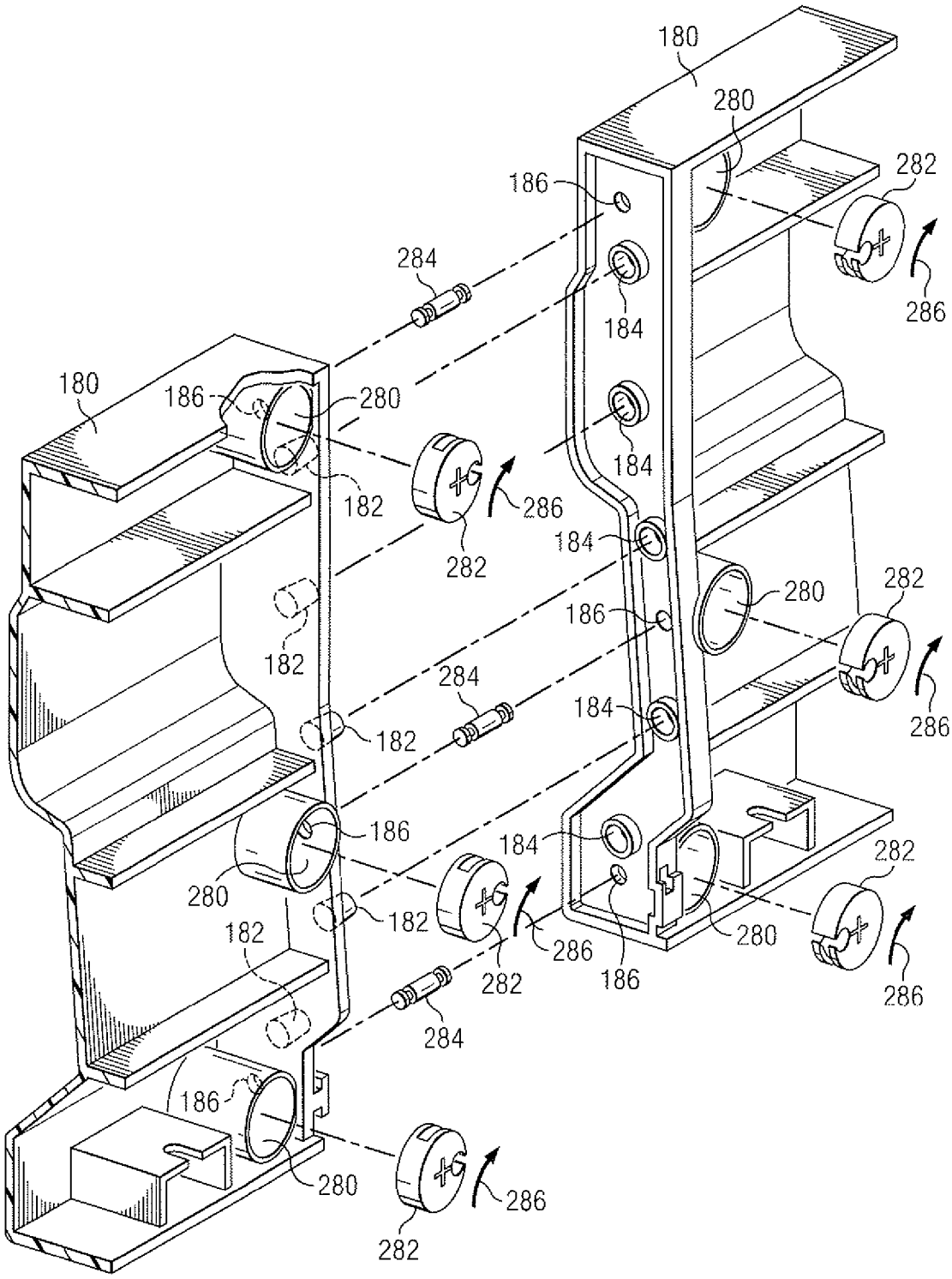
FIG. 5*c* is an exploded perspective side view depicting the connection of two side panels by a twist lock fastener in accordance with one embodiment of the present invention.

Further, other ways of fastening the side panels with minimal use of tools can also be provided without departing from the spirit and scope of the present invention. In one embodiment, casket components such as two or more side panels are pressure fit together. In one embodiment, two or more side panels are pressure fit together by a twist lock fastener. For example, FIG. 5*c* is an exploded perspective side view depicting the connection of two side panels 180 by a twist lock fastener in accordance with one embodiment of the present invention. As shown in FIG. 5*c*, each side panel 180 can be molded to include a plurality of cam receiving housings 280. An aperture 186 can be provided adjacent the housing 280 to permit placement of a dowel 284. A first side panel 180 can comprise a plurality of tapered or non-tapered alignment protrusions 182 that can be aligned with a plurality of corresponding tapered or non-tapered alignment slots 184 integral to a second side panel 180. The alignment slots 184 and alignment protrusions 182 can help to align the two side panels 180 during assembly. The first and second side panels 180 can then be pressure-fit and secured together by a twist lock fastener. In the embodiment shown, the twist lock fastener comprises two cams 282 and a dowel 284. The dowel 284 is placed into a housing 280 and through the aperture 186 such that the dowel 284 resides partially in a housing 280 of each side panel 180. A cam 282 can then be placed into each housing 280 over the dowel 284 and each cam 282 can then be turned in the direction of the arrow 286 to secure the side panels 180 together. Although the cam 282 can be configured such that it can be turned with a screwdriver as is depicted in FIG. 5*c*, the cam 282, in an embodiment not shown, can also be configured to have an extension similar to a wing nut that can be hand-tightened to help reduce the number of or eliminate all tools required for assembly. In one embodiment, a single cam can be used with a dowel designed for single cam fastening.

Figure 6B:
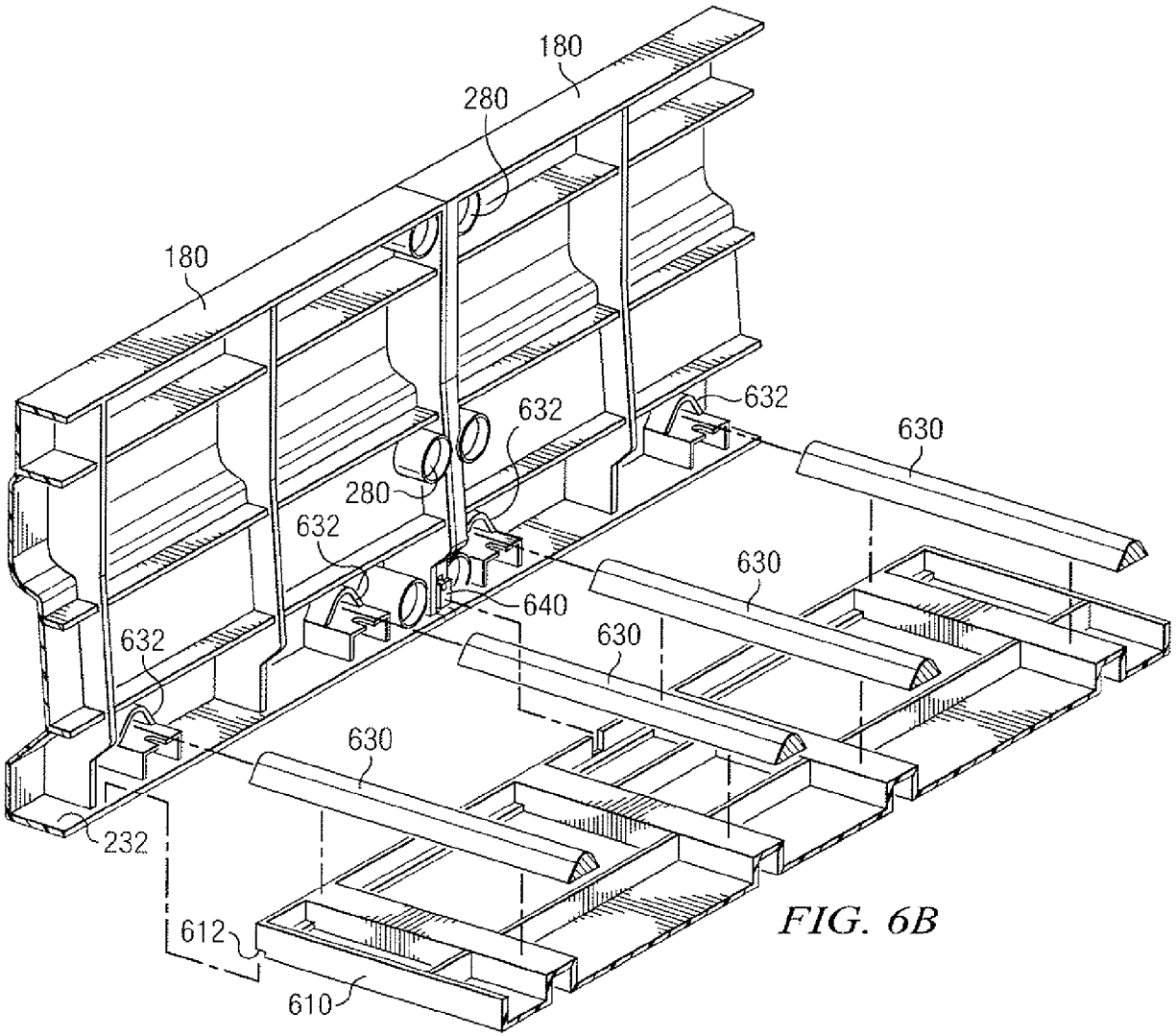
FIG. 6*b* is a perspective view depicting a base section in accordance with an alternative embodiment of the present invention.
Figure 6A:
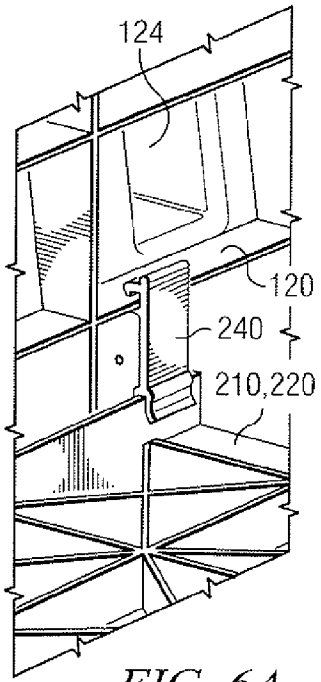
FIG. 6*a* is a perspective view showing how the base section can be further secured to a side panel in accordance with one embodiment of the present invention.

FIG. 6*a* is a perspective view showing how the base section can be further secured to a side panel in accordance with one embodiment of the present invention. As depicted in FIG. 4, the base section 210 slidably connects to the side panel 120 and the clip 240, as depicted in FIG. 6*a*, can be used merely add support and help secure the connection under heavier loads. One or more clips 240 can be used to further secure each side of a base end 210 and/or a middle base portion 220 to the side panel 120 and/or the end panel 140. In one embodiment, one or more clips 240 are used at or near joints between the base end 210 and the middle base portion 220. Such configuration is beneficial for several reasons.

First, the clips 240 permit the side panels 120 to be securely fastened to the base end 210 or middle base portion 220 with no tools. Second, because the connection is intuitive to the user, the design facilitates assembly. Third, because no screws or nails are required, the connection can be made relatively quickly leading to more efficient casket assembly.

In one embodiment, the clip 240 mouth is designed to be slightly smaller than the ribs inside a side panel 120 or end panel 140 (not shown) or the base end 210 and/or base portion 220. This enables the clip 240 to pressure-fit onto and retain the ribs of the side panel 120 and portion of the base end 210 and/or base portion 220 to better secure the connection between the side panel 120 and any base section 210 220. Also depicted in FIG. 6*a* is a side panel handrail receiving member 124 which is discussed in more detail below.

FIG. 6*b* is a perspective view depicting a base section in accordance with an alternative embodiment of the present invention. A portion 612 of the base section 610 is disposed on the side panel ledge 232. A stiffening bar 630, made of metal or plastic, can be placed into a housing 632 disposed near the side panel ledge 232. In one embodiment, the housing 632 is integral with the side panel 180. A joint protrusion 640 can be provided to help hold the base section 610 in the proper position during and after assembly.

Figure 7:
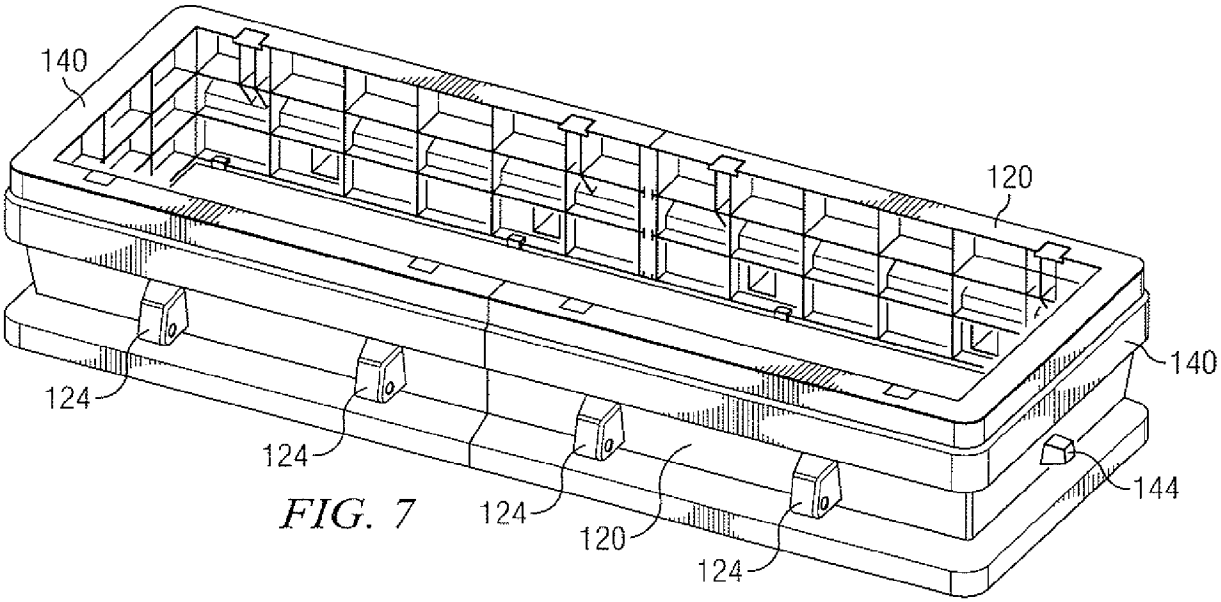
FIG. 7 is a perspective view of a partially constructed casket in accordance with one embodiment of the present invention.

FIG. 7 is a perspective view of a partially constructed casket in accordance with one embodiment of the present invention. In one embodiment, one or more side panel handrail receiving members 124 are formed integrally with each side panel 120. In an alternative embodiment (not shown), one or more handrail receiving members are formed integrally with a base section. Thus, in one embodiment, at least one side panel or base section further comprises one or more handrail receiving members 124 wherein the handrail receiving member is integral to the side panel or base section. One advantage of an integral handrail receiving member 124 is that forces imparted through the hole to the handrail receiving member 124 by a handrail are spread more evenly over a larger area than would occur if the handrail receiving member 124 were attached by some type of fastener. Consequently, an integral handrail receiving member 124 has greater strength and can withstand a heavier load that a non-integral, fastened handrail receiving member. Another advantage is that the hole in the handrail receiving member can be formed at the same time as the side panel or base section resulting in less assembly to the end-user.

Figure 8:
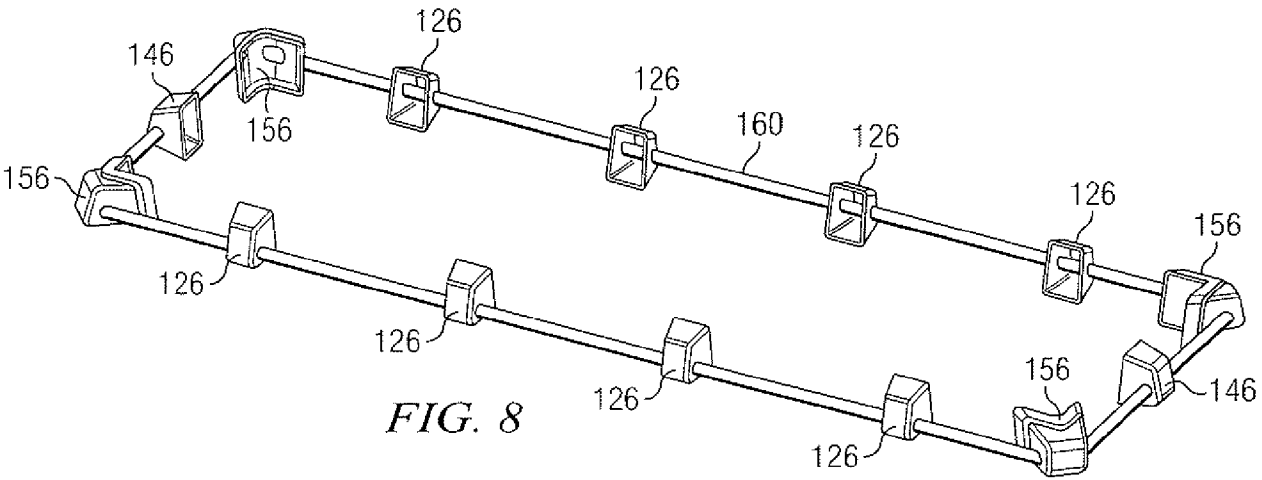
FIG. 8 is a perspective view depicting the pallbearer handrail in accordance with one embodiment of the present invention.

FIG. 8 is a perspective view depicting the pallbearer handrail 160 in accordance with one embodiment of the present invention. Referring to FIG. 7 and FIG. 8, the side panel handrail receiving members 124 each comprise a hole for insertion of the handrail 160. In one embodiment, the handrail 160 comprises four separate rails; two long handrails disposed through the handrail receiving members 124 and two shorter handrails adjacent the end panels 140. Once the casket in FIG. 7 has been constructed, decorative handrail covers 126 can be snap-fit over the side panel 120 handrail receiving members 124. The decorative handrail covers 126 146 156 can comprise any decorative design feature including a cross or other emblem. The long handrails can then be inserted through the holes in the receiving members 124. The shorter handrails can then be inserted through the decorative end panel covers 146 and through the four corner handrail covers 156. One advantage of such a configuration is that it permits attachment of a handrail without the use of tools. A coupling or corner union (not shown) inside the corner handrail covers 156 connects the shorter handrails to the longer handrails. Any of the decorative handrail covers 126 146 156 can be attached by any number of ways including a snap-fit connection, a fastener connection including a nut or bolt or screw, an adhesive such as double-sided tape, and/or can be held into place by the handrail 160 itself. In one embodiment, the handrail 160 comprises two separate rails adjacent the side panels 120.

Figure 9A:
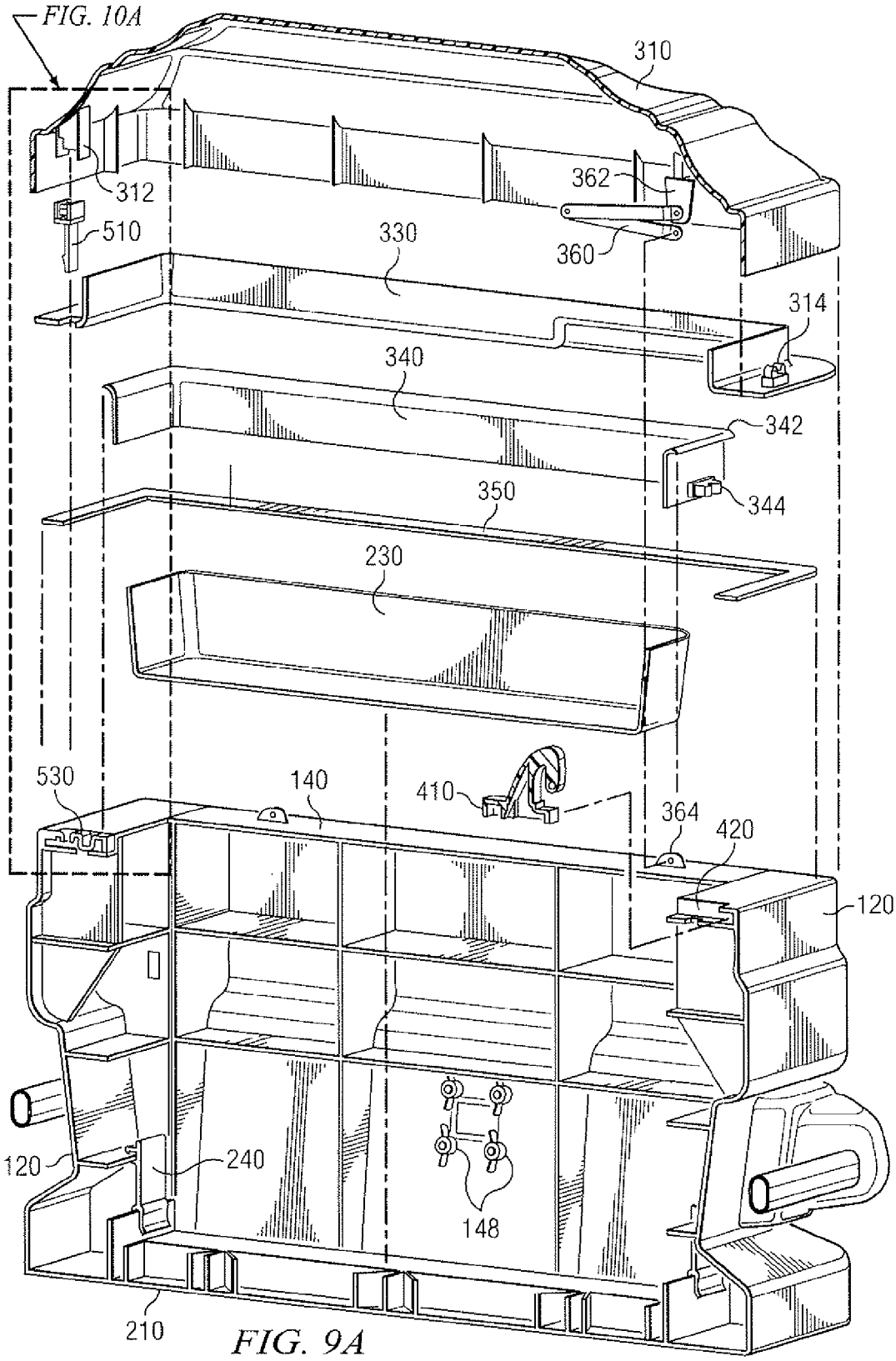
FIG. 9*a* is a partial cutaway exploded view of the inside of one end of the casket in accordance with one embodiment of the present invention.
Figure 9B:
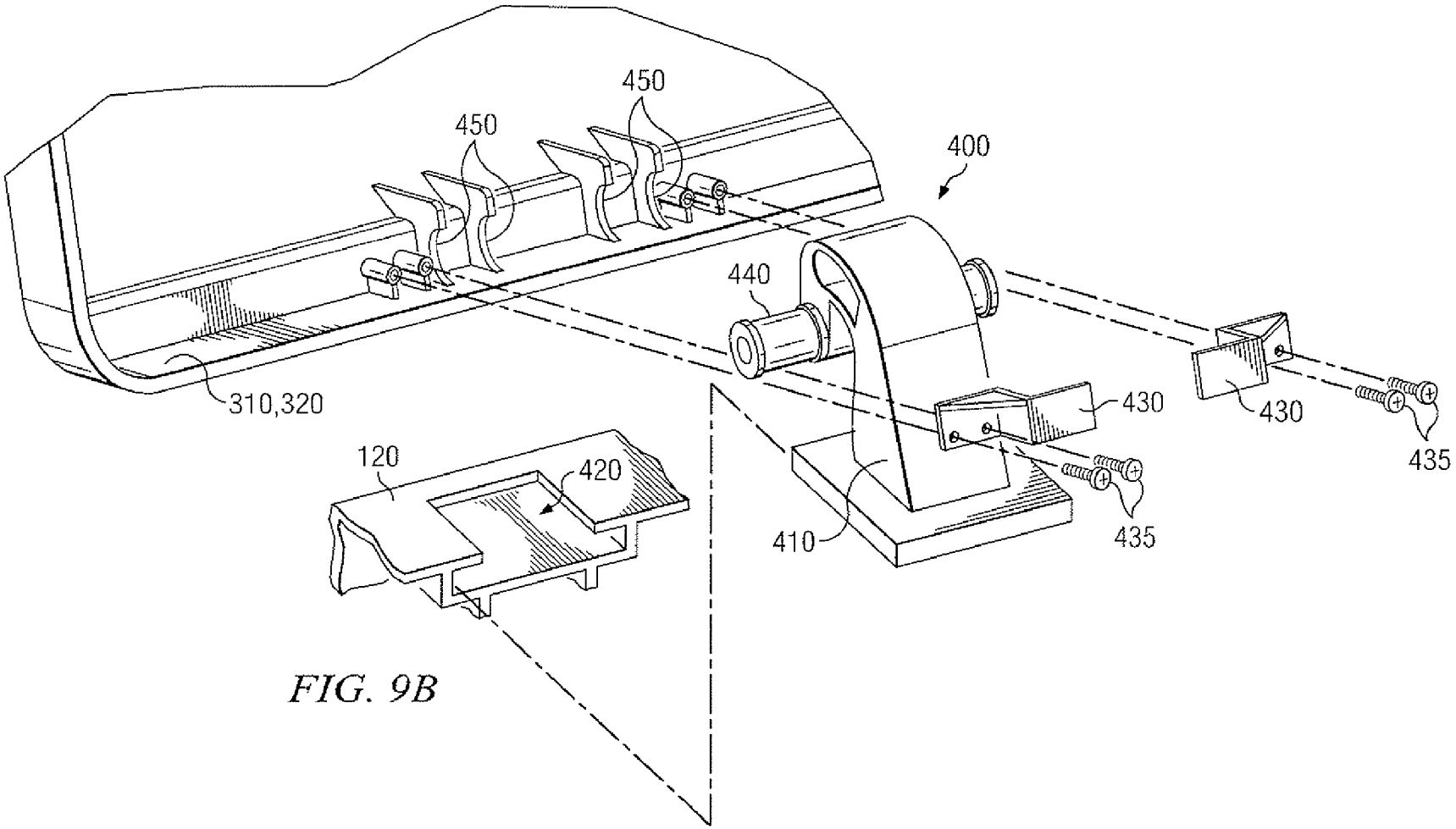
FIG. 9*b* is an exploded perspective view depicting the hinge assembly in accordance with one embodiment of the present invention.

FIG. 9*a* is a partial cutaway exploded view of the inside of one end of the casket in accordance with one embodiment of the present invention. FIG. 9*b* is an exploded perspective view depicting the hinge assembly in accordance with one embodiment of the present invention. Referring to FIGS. 9*a* and 9*b*, the hinge assembly 400 comprises a hinge base 410 slidably connected into a hinge slot 420, wherein the hinge slot 420 is located on the top portion of the side panel 120. Two pieces comprising a hinge pin 440 can be placed into a receiving hole in the hinge base 410 and press-fit together. In one embodiment, the entire hinge assembly 400 is made from an injection molded plastic. One or more hinge pin 440 receiving members 450 can be integral to the first lid section 310 and/or second lid section 320. In one embodiment, screws 435 can be used to attach a hinge bracket 430 to the lid 310 320. In one embodiment, only a screwdriver is needed to attach the hinge assembly 400 to the lid 310 320. Consequently, in one embodiment of the present invention, the casket can be assembled with minimal tools, the only tools potentially necessary being a screwdriver and a rubber mallet. It should also be pointed out that the screws 435 can be replaced with a screw having a configuration that can permit the hinge to be fastened to the lid 310 320 in a manner that requires no tools. For example, a pair of screws 435 having an extension similar to a wing nut that can be hand-tightened can be used. In one embodiment, such extension does not exceed the diameter of the head of the screw 435. In one embodiment, a cotter-pin type fastener is used. Thus, some embodiments of the present invention provide a modular casket that requires no tools for assembly.

Figure 9C:
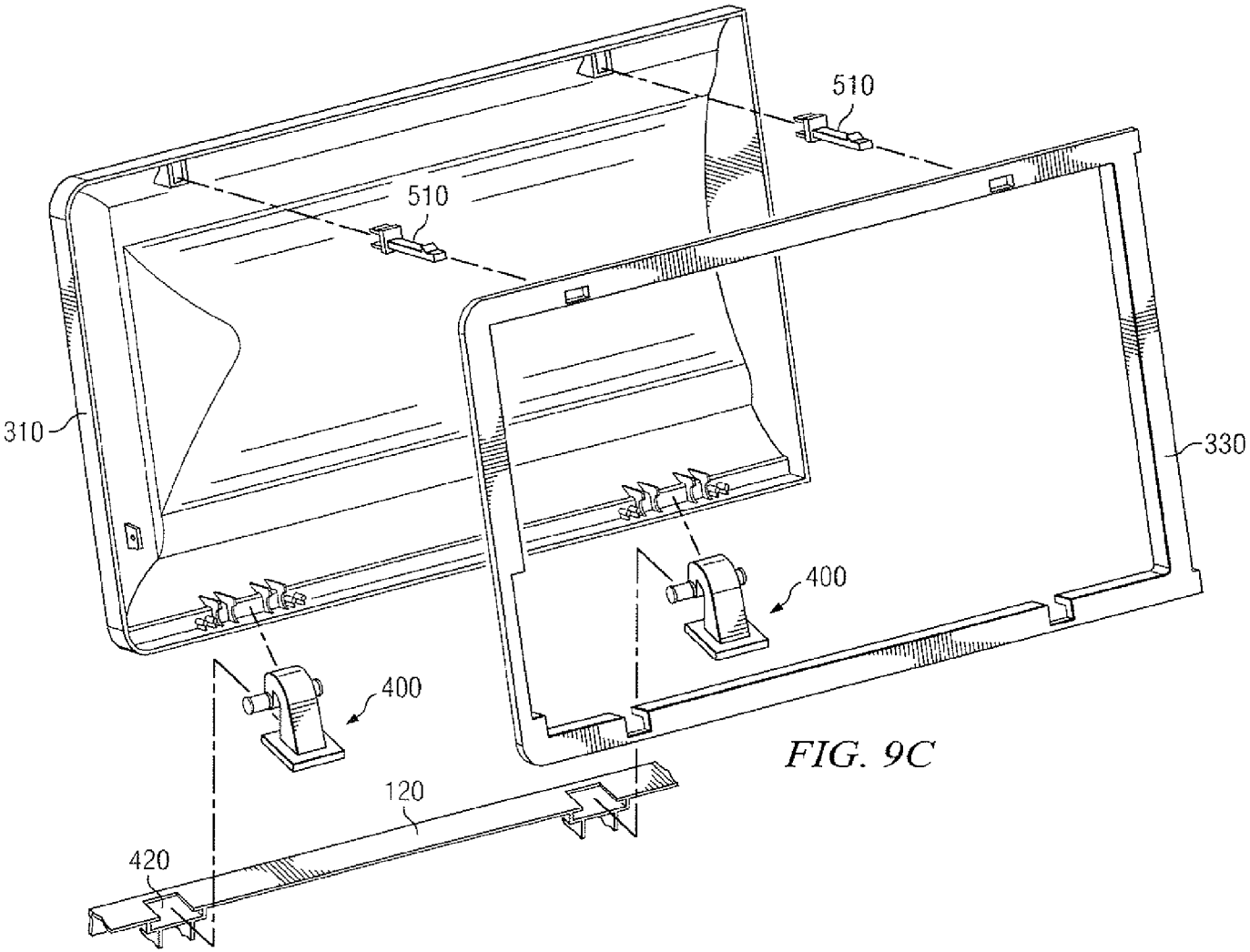
FIG. 9*c* is a partial exploded perspective view taken depicting the lid assembly in accordance with one embodiment of the present invention.

FIG. 9*c* is a partial exploded perspective view depicting the lid assembly in accordance with one embodiment of the present invention. Referring to FIGS. 9*a* and 9*c*, a lid frame 330 can be placed about the inner periphery of the lid 310. The lid frame 330 can be injection molded such that a plurality of metal heart-shaped clips 314 can be snap-fit onto the lid frame 330, as best shown by FIG. 9*a*. The mouth end of the metal clip 314 can engage a corresponding rib on the lid 310 to hold the lid frame 330 in place. Because the metal clip 314 comprises a sharp mouth surface, the mouth surface can grip an adjoining rib. A lid frame can similarly be joined to any other lid sections including a second lid section 320.

Figure 9D:
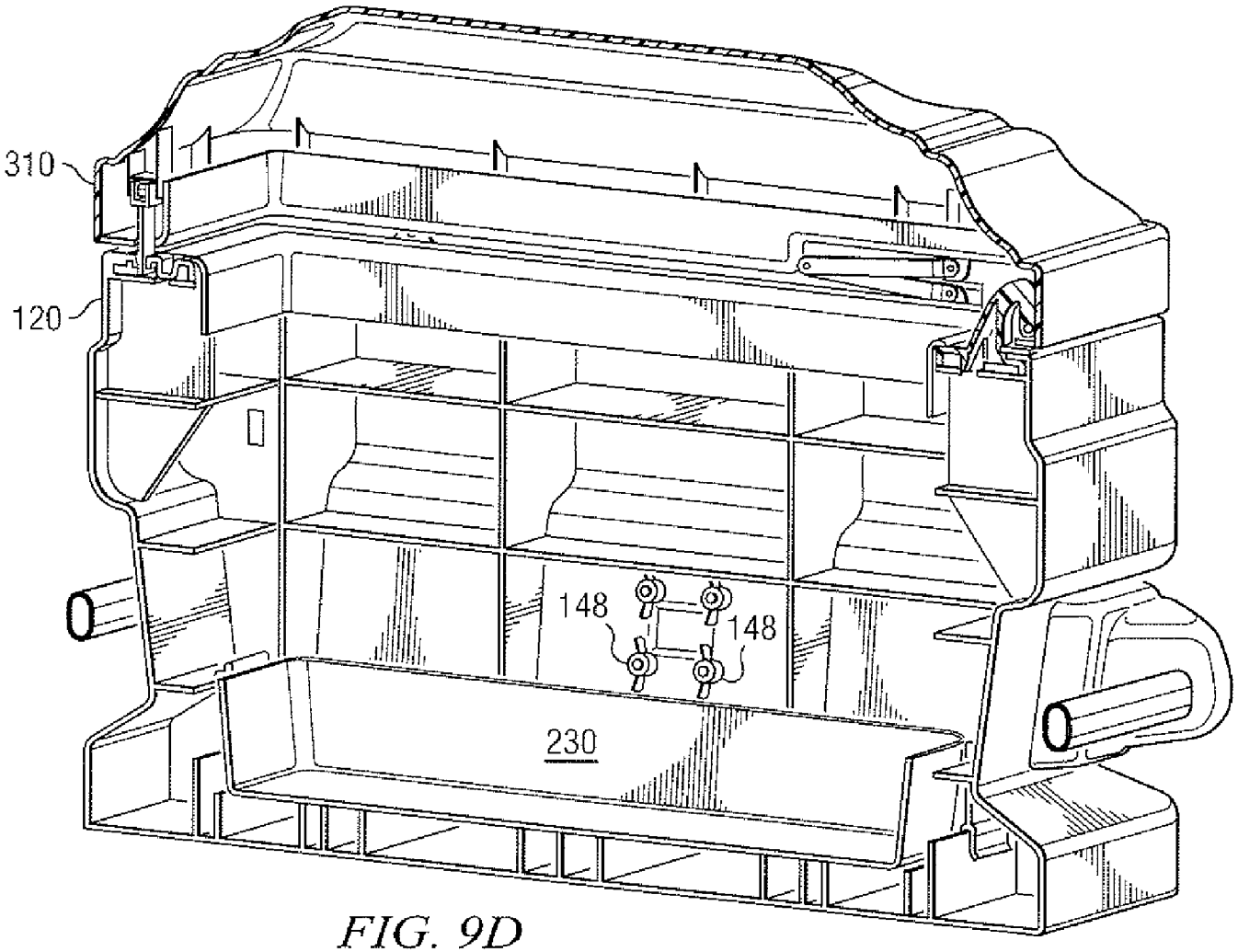
FIG. 9*d* is a partial cutaway view depicting the end of the casket from the inside in accordance with one embodiment of the present invention.

FIG. 9*d* is a partial cutaway view depicting the end of the casket from the inside in accordance with one embodiment of the present invention. Referring to FIGS. 9*a* and 9*d*, in one embodiment, the casket comprises a casket frame 340 and gasket 350 disposed about the outer, upper perimeter of the side panels 120 and end panels 140. The casket frame 340 can provide aesthetic features such as a lip 342. The casket frame 340 can be attached to the side panels 120 and end panels 140 by a plurality of metal clips 344 in the same manner that the lid frame is attached to the lid 310 as discussed above.

In one embodiment, a fabric covers the inside of the side panels 120 and end panels 140. The fabric can be attached to the upper side panels 120 and end panels 140 by the metal clips 344. In one embodiment, a pan 230 is placed in the bottom of the casket. A fabric material may or may not also cover the pan 230. In one embodiment an inflatable air mattress is also placed into the casket to provide the desired elevation of the body in an open casket or other ceremony. The gasket 350 can be attached by an adhesive. A simple arm assembly 360 can be attached to the lid locking arm mount 362 and the end panel locking arm mount 364 to prevent the lid from opening too widely. Each of these arm mounts 362 364 can be integrally injection molded with their respective pieces. Also shown in FIG. 9*d* are the wingnuts 148 used to fasten the decorative end panel handrail cover 146 to the outside of the end panel 140.

Figure 10A:
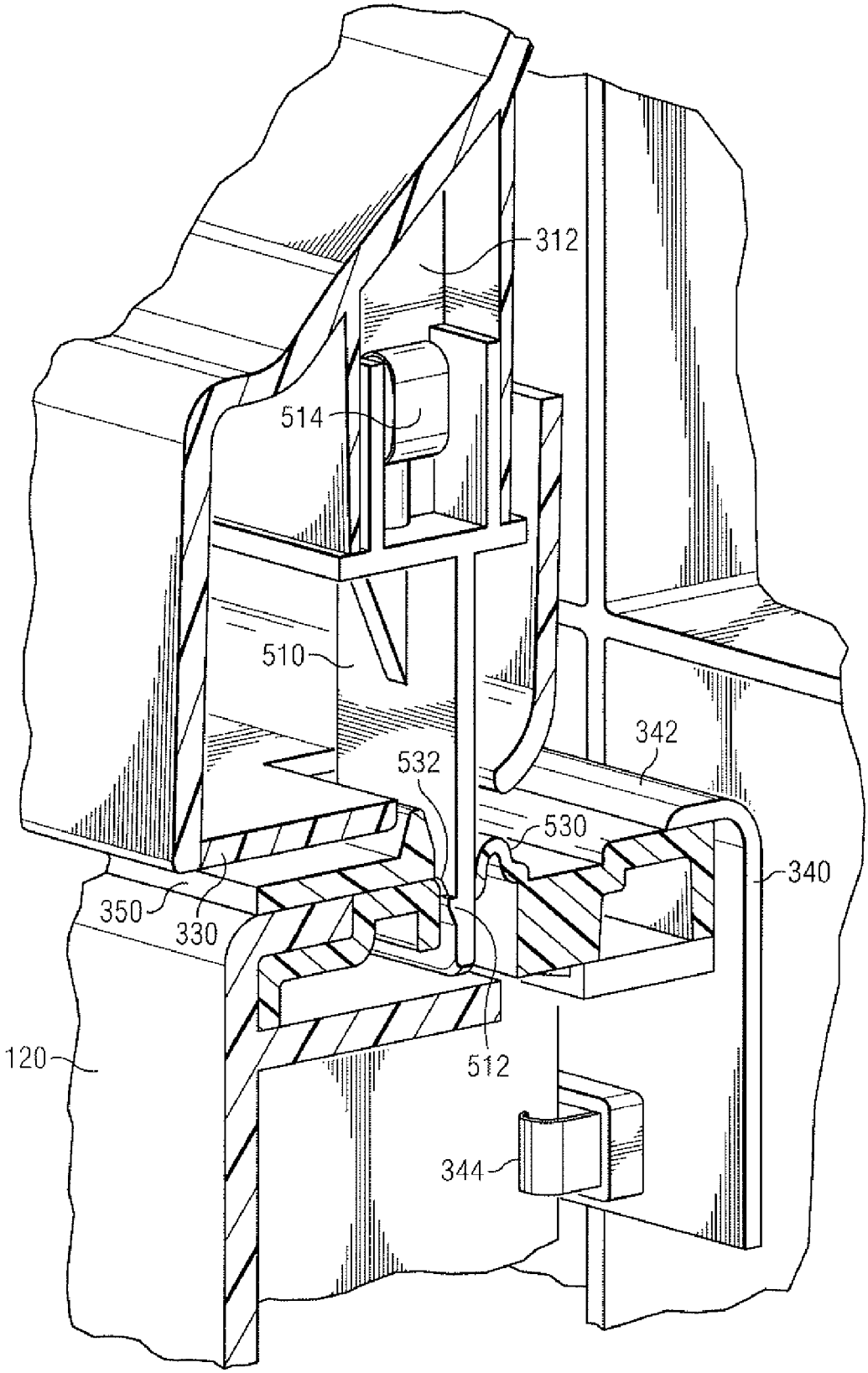
FIG. 10*a* is a partial cutaway view of the portion labeled FIG. 10A in FIG. 9*a* depicting the locking mechanism in accordance with one embodiment of the present invention.
Figure 10B:
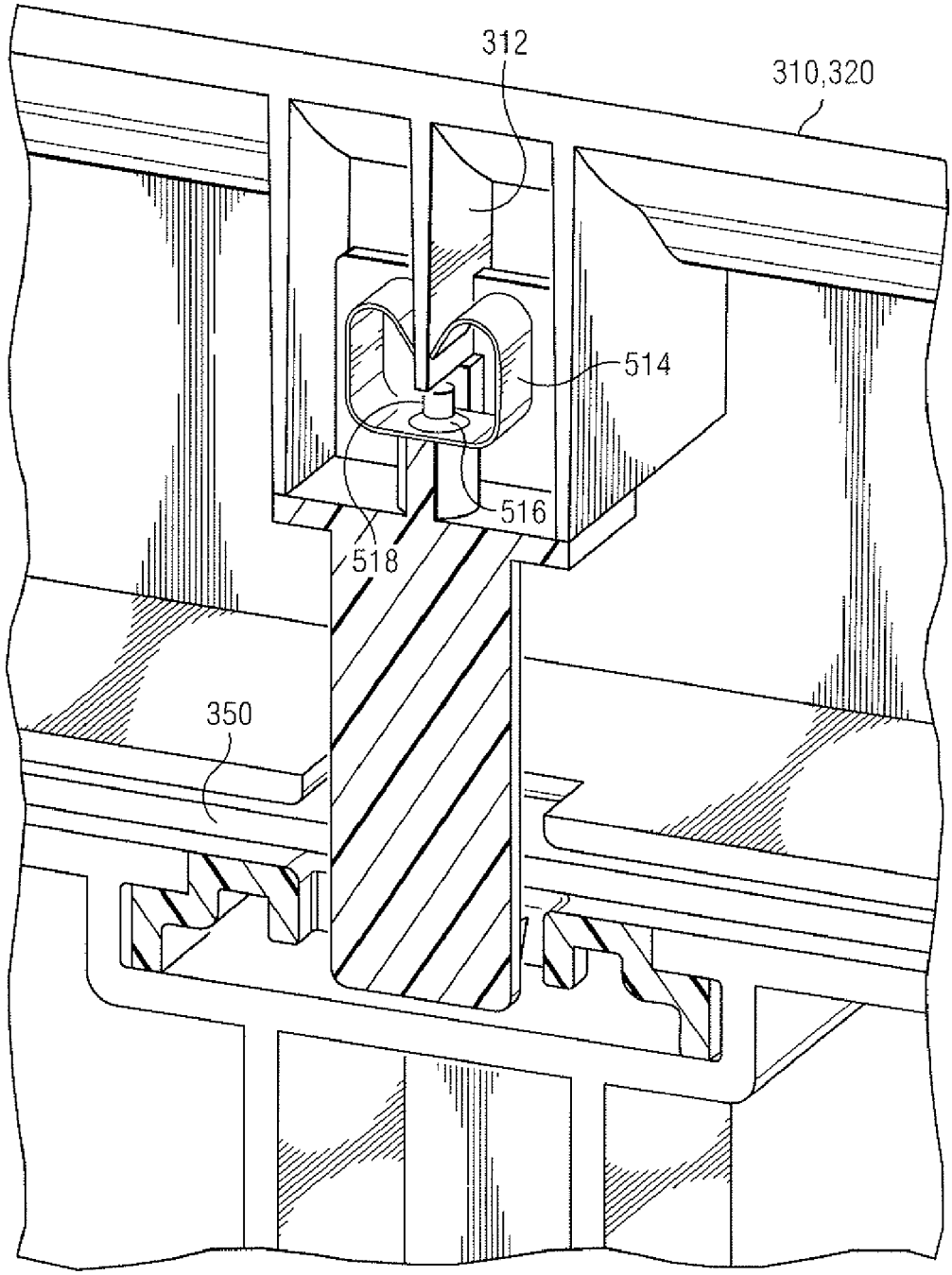
FIG. 10*b* is an alternative partial cutaway view depicting the locking mechanism depicted in FIG. 10*a*.

FIG. 10*a* is a partial cutaway view of the portion labeled FIG. 10A in FIG. 9*a* depicting the locking mechanism in accordance with one embodiment of the present invention. FIG. 10*b* is an alternative partial cutaway view depicting the locking mechanism depicted in FIG. 10*a*. Referring to FIGS. 10*a* and 10*b*) in one embodiment, a latch assembly comprises a clip 514, a male latch 510, and a female latch 530. In one embodiment, the clip 514 comprises a raised collar 516 that can be press fit around the cylindrical tip 518 integral to the latch 510. In one embodiment, the mouth of the clip 514 can then be press-fit onto a rib 312 integral to a lid section 310 320. A female latch 530 can be slidably attached to the top portion of the sidewall 120. A male latch ledge 512 mates with a female latch ledge 532 after insertion into the female latch 530. One advantage of such configuration is that no latches are visible on the outside of the casket. Thus, the latch is not fastened to an outer periphery of the side panel or lid.

To open, a rigid, flat card (e.g. a credit-card like object) can be placed between the lid frame 330 and the side panel 120 and can be used to push the male latch 510 inward to permit the lid 310 to open. In one embodiment a resilient, rubber-like L-shaped gasket 350 is about the upper perimeter of the side panel 120 and the credit card-like object can press a portion of the gasket 350 into the male latch 510 to permit the lid 310 to open.

One skilled in the art would recognize that such feature could be reversed and in one embodiment the female latch portion 530 is attached to the lid 310 320 and the male portion 510 extends from the side panel 120. Similarly, one skilled in the art would recognize that both the female latch 530 and male latch 510 can be attached to the lid 310 320 or the side panel 120 by a clip or by a pressure-fit mount. The present invention should therefore be construed to include all embodiments wherein male 510 or female latch 530 is attached to a lid 310 320, and wherein further said male latch 510 or said female latch 530 removably fastens the lid 310 320 to the side panel 120, wherein said latch assembly is snap-fit together. Another advantage of such configuration is that no tools are required to attach the latch assembly to the side panel 120 or lid 310 320.

Figure 11:
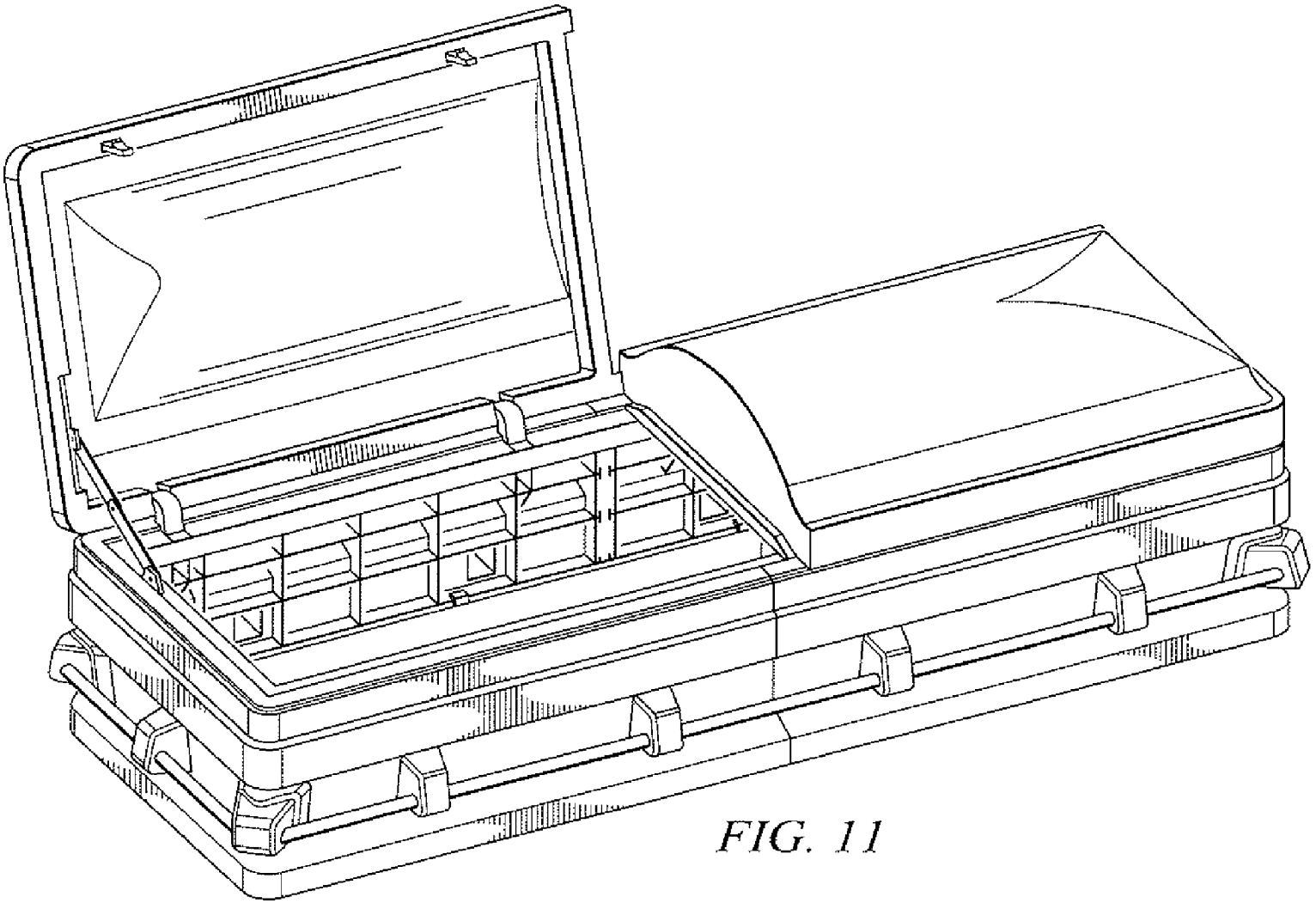
FIG. 11 is a top perspective view of the casket in accordance with one embodiment of the present invention.

FIG. 11 is a top perspective view of the casket in accordance with one embodiment of the present invention. Like traditional caskets, the present casket provides an open casket viewing option.

Figure 12:
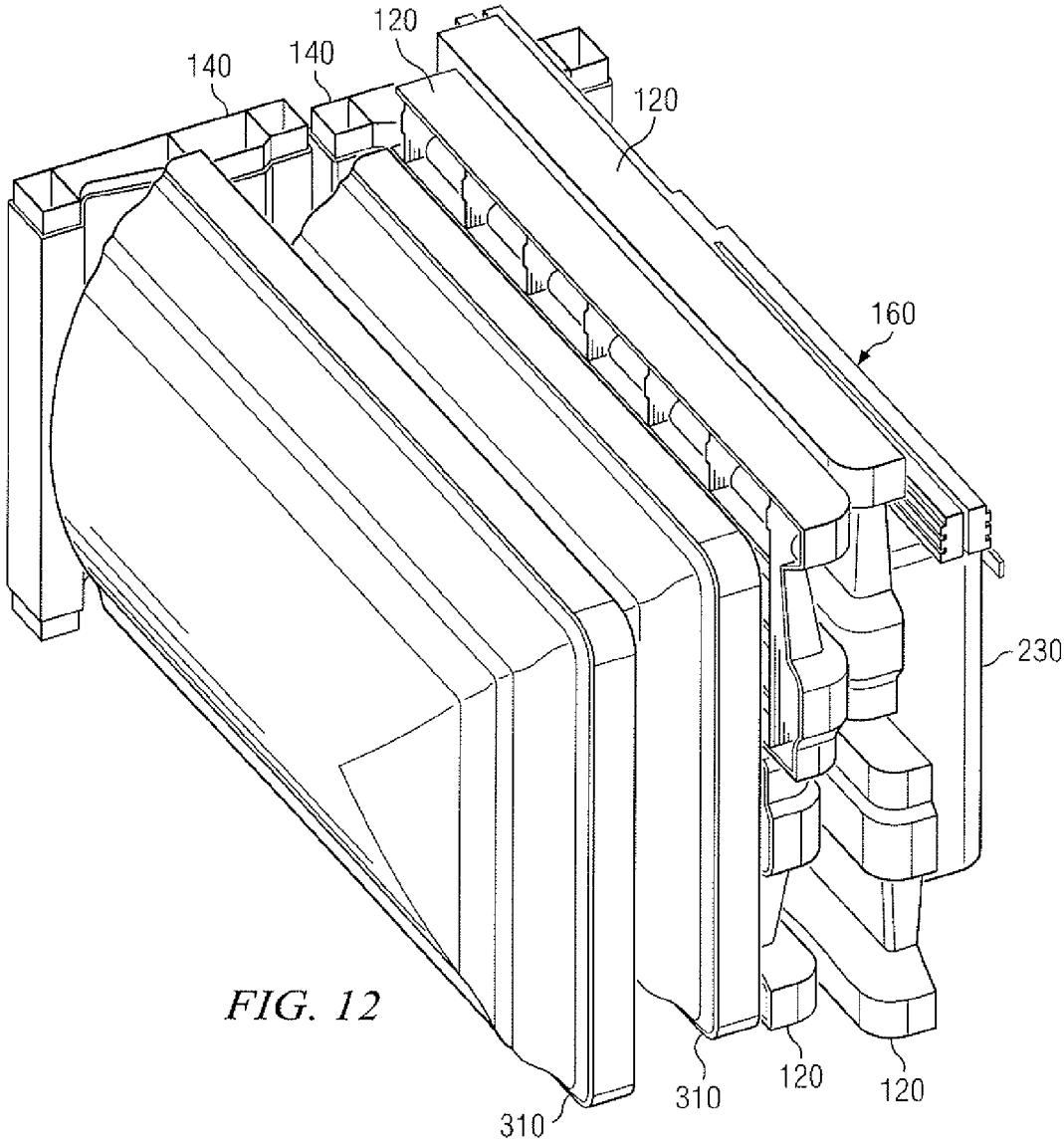
FIG. 12 is a simplified perspective view illustrating the packing configuration of the kit for making a modular casket in accordance with one embodiment of the present invention.

FIG. 12 is a simplified perspective view of illustrating the packing configuration of the kit for making a modular casket in accordance with one embodiment of the present invention. As shown in FIG. 12, the various parts of the casket can be efficiently packaged as a kit in compact form for shipment or storage until partial or full assembly is desired. In one embodiment, the lid sections 310 can be adjacent one another and alternatively nested. The side panels 120 can be can be grouped together between the lid section 310 and a base pan 230. Nested within the base pan 230 can be one or more nested base sections (not shown). Adjacent end panels 140 can be oriented perpendicular to the side panels 120 or lid 310. In one embodiment (not shown), the kit comprises two end panels, two sidewalls and a base section. It should be pointed out that the exemplary packing configuration depicted in FIG. 12 is for purposes of illustration and not for purposes of limitation. Any compact or efficient shipping configuration can be used that minimizes the storage volume required by a disassembled casket. In one embodiment, the stored or packaged volume of the casket is approximately 50% less than the assembled volume or volume of the casket when fully assembled. The disassembled casket comprising the kit for making the modular casket can then be placed into a shipping container to protect the casket from damage during shipment.

In one embodiment, the invention is directed towards a method of placing of an integral image on one or more modular casket parts. As used herein, the tern "image" is defined as a visible design contrast as compared to the color of the molded casket piece prior to the application of a film and encompasses a single solid color in addition to patterns of varying colors. The image can be applied to a film sheet and the film sheet can then be mated to one or more casket pieces.

Figure 13B:
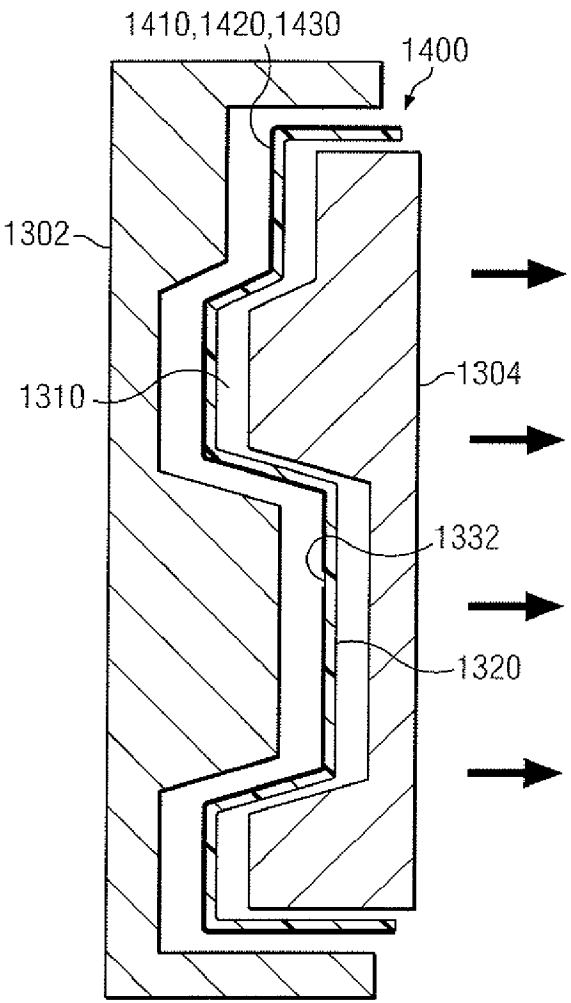
FIG. 13*b* is a simplified cross-sectional representation of an injection mold having a multi-layer film disposed on the exterior of a casket side panel in accordance with one embodiment of the present invention.
Figure 13A:
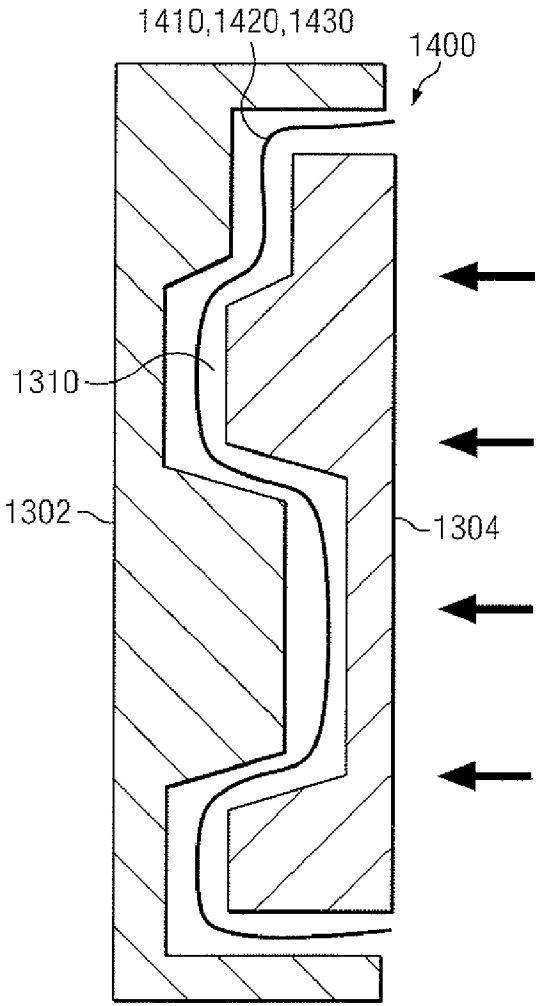
FIG. 13*a* is a simplified cross-sectional representation of an injection mold having a multi-layer film in accordance with one embodiment of the present invention.

In one embodiment, a film sheet having an image is placed into an injection mold prior to formation of a casket piece through an injection mold process. FIG. 13*a* is a simplified cross-sectional representation of an injection mold having a multi-layer film 1400 prior to the introduction of a molten plastic in accordance with one embodiment of the present invention. FIG. 13*b* is a simplified cross-sectional representation of an injection mold having a multi-layer film 1400 disposed on the exterior 1332 of a molded casket side panel 1320 in accordance with one embodiment of the present invention. As shown in FIG. 13*a*, a movable mold 1304 and a stationary mold 1302 defines a mold cavity 1310. A multilayer film 1400 is placed into the mold cavity 1310. Referring to FIG. 13*b*, the stationary mold 1302 then engages the mold cavity 1310 and molten plastic is injected into the mold cavity 1310 through injection ports (not shown) to form a molded casket part, such as a casket side panel 1320, that corresponds to the shape of the mold and having a multi-layer film 1400 with an image disposed on the casket exterior 1332. The molded casket part is then cooled to solidify the casket part 1320. In one embodiment, as the casket part 1320 is solidified, the multi-layer film 1400 becomes embedded in the exterior 1332 of the casket side panel 1320. As shown, the multi-layer film 1400 terminates at the terminal end of the casket piece 1320. The movable mold 1304 opens by moving in the general direction depicted by the arrows and the solidified casket part 1320 is then removed from the mold cavity 1310.

In one embodiment (not shown), the multi-layer film 1400 terminates not at the terminal end of the casket piece, but within the molded plastic piece by design. Such embodiment can be used, for example, to provide a two-tone color scheme—the first color can be provided by the injected plastic and the second color can be provided by the film.

Figure 14:
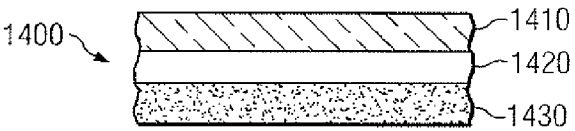
FIG. 14 (PRIOR ART)
FIG. 14 is a schematic cross-section of a prior art multi-layer film.

In one embodiment, the film, which can comprise a multi-layer or laminate film 1400 comprises an image. FIG. 14 is a schematic cross of a prior art multi-layer film 1400. The image can be provided as by an ink layer 1420 on a multi-layer film. As shown, the multi-layer film comprises a transparent polymer protective layer 1410 having an ink graphic 1420 layer and an optional adhesive layer 1430. Such films are well known in the art. For example, to make such a film, the image 1420 can be reverse printed onto a Acrylonitrile Butadiene Styrene (ABS), glycol modified polyethylene terephthlate (PETg) 1410 or other suitable film 1410 by any suitable graphics application method. There are several kinds of graphics application methods well-known in the art including gravure and flexography. In one embodiment, a holographic image is printed using a metallic ink. In one embodiment, the metallic ink is modified by a laser. The optional adhesive layer 1430 can be applied over the ink layer 1420 by extrusion alone or by lamination. The above example of a multi-layer film having an image is for purposes of illustration and not limitation. Any monolayer or multi-layer film that can be applied and/or embedded onto a casket piece can be used in accordance with one embodiment of the present invention. Further, in one embodiment, a transparent film is applied to a casket piece as a layer of protection for the casket.

The method of placing the pre-made image onto the casket piece can be achieved in numerous ways well known in the art including, but not limited to, non-structural appliqué, vacuum thermoforming, and dipping.

Figure 15B:
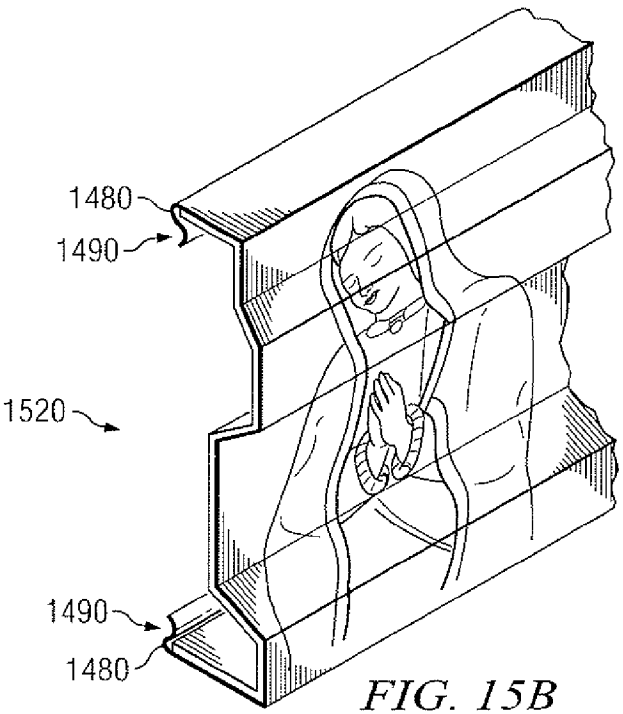
FIG. 15*b* is a perspective view of a portion of a casket side panel having an image of the Virgin of Guadalupe.
Figure 15A:
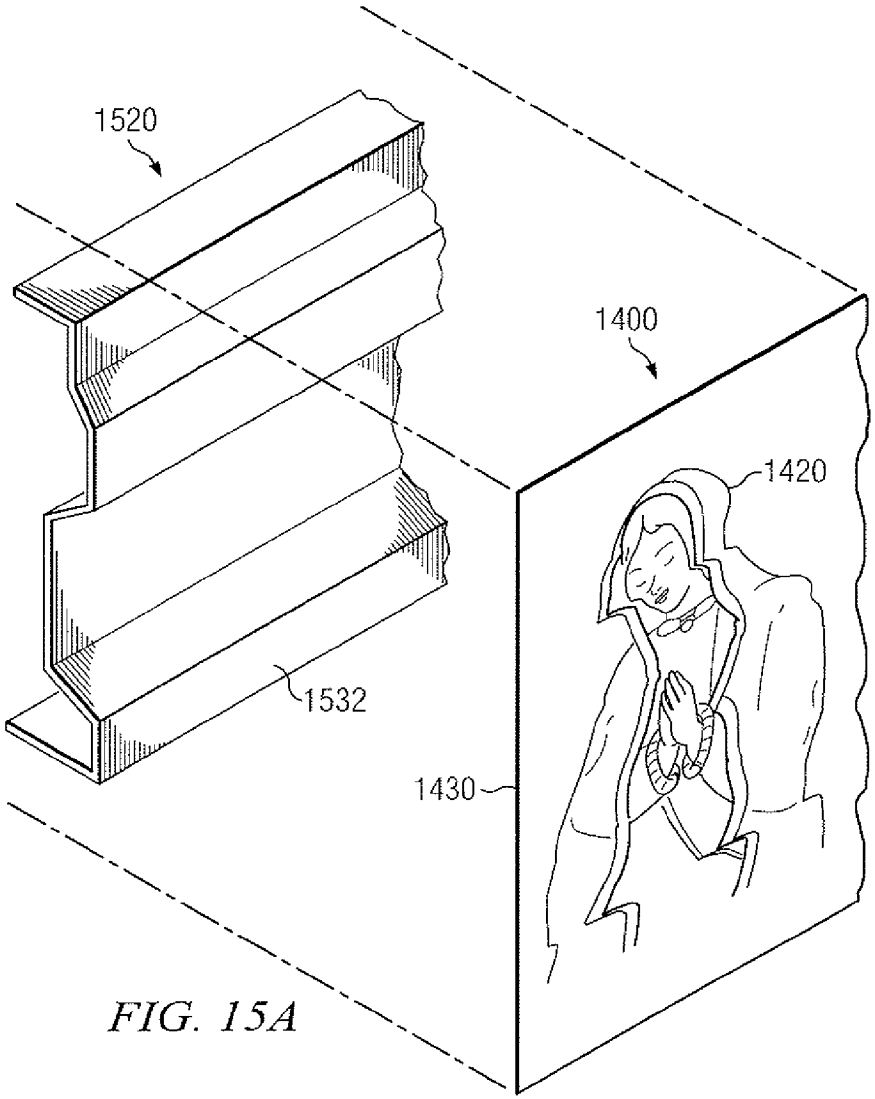
FIG. 15*a* depicts an exploded perspective view of a multi-layer film having an image of the Virgin of Guadalupe and a portion of a solidified casket side panel having an exterior in accordance with one embodiment of the present invention.

FIG. 15*a* depicts an exploded perspective view of a multi-layer film 1400 having an image 1420 of the Virgin of Guadalupe and a portion of a solidified casket side panel 1520 having an exterior 1532 in accordance with one embodiment of the present invention. In one embodiment, the entire film sheet 1400 is heated so that when the sheet is subsequently delivered to a forming station (not shown), an overall temperature balance has been attained. On being heated, the sheet is conveyed to the forming station where by one of several methods it is forced over and contoured onto the casket piece 1520, as shown in FIG. 15*b*.

The thermoforming of the sheet onto the casket part can be performed by means of different, conventional techniques, for instance, in vacuum thermoforming, a pre-cut sheet of multi-layer film sheet 1400 having an image 1420 is heated. A vacuum can be applied to remove the air between the multi-layer film sheet 1400 and the casket piece 1520 and/or a counter mold can be used to help force the sheet onto the casket piece 1520. The residual heat on the film sheet 1400 can be removed after forming. After cooling, the end product is removed from the forming station and sent to a trim press where the end product is trimmed from the web. The adhesive layer 1430 bonds the multi-layer film onto the casket exterior 1532.

It should be pointed out that it may be advantageous for the image 1420 to be printed onto the multi-layer film in a way that adjusts for distortion that will occur when the image is contoured onto the casket piece 1520. The adjustment for distortion can be made as follows. The image is first developed as a standard flat graphic. A sheet the same size as the production sheet with a grid pattern printed on it is formed over the actual part (or representation of the part) to create a formed grid. The grid locations of the formed grid sheet are matched to the original flat graphic. The points on the flat graphic are moved using standard imaging software to a new location opposite the movement seen in the formed grid. The result is a new final graphic that when formed over the casket part shows no distortion of the graphic regardless of the graphic used. Consequently, in one embodiment, the present invention provides a way to compensate for distortion and results in a distrotionless graphic.

Figure 13D:
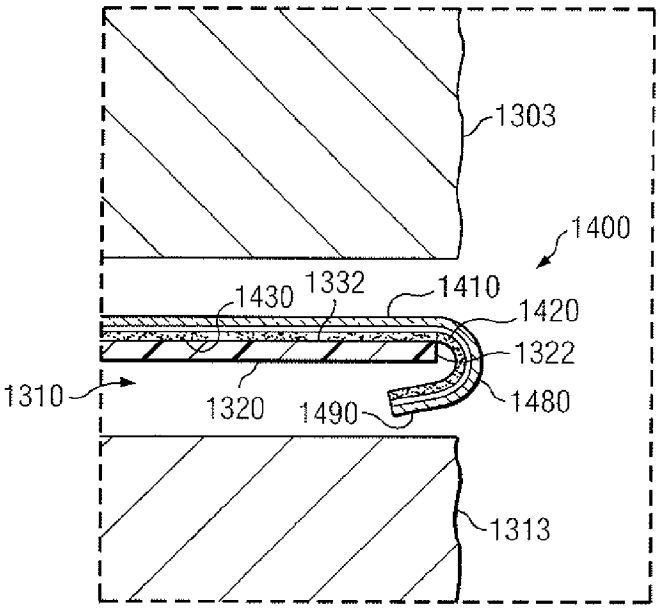
FIG. 13*d* is a partial blown-up view of FIG. 13*c* depicting the terminal end of the multi-layer film in accordance with one embodiment of the present invention.
Figure 13C:
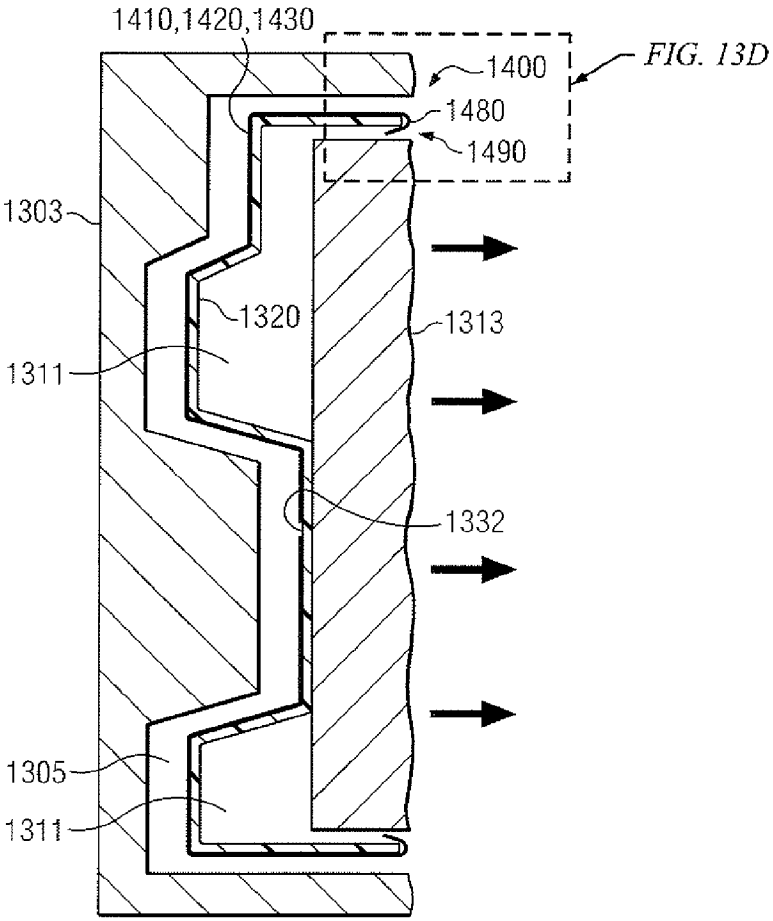
FIG. 13*c* is a simplified cross-sectional representation depicting the trap forming process in accordance with one embodiment of the present invention.

In one embodiment, a trap-forming process is used to apply the film to a casket part. FIG. 13*c* is a simplified cross-sectional representation depicting the trap forming process in accordance with one embodiment of the present invention. FIG. 13*d* is a partial blown-up view of FIG. 13*c* depicting the terminal end of the multi-layer film 1400 in accordance with one embodiment of the present invention. Referring to FIGS. 13*c* and 13*d*, a sheet of film or film sheet 1400 comprising a suitable resin, polymer, or similar material is heated in one embodiment to the point where the sheet is malleable. In one embodiment, the film is not heated and comprises a pressure sensitive adhesive layer 1430. The sheet is then lowered onto a molded casket part 1320. In one embodiment, the edges of the sheet 1400 are pulled down around the periphery of the casket part until contact with the terminal ends 1322 of the casket part 1320 is made.

In one embodiment, the sheet 1400 stretches and conforms to the casket part only to the extent of the pulling of the sheet 1400 down. Next, a box 1303 having a box interior 1305 roughly the size of the exterior 1332 dimension of the casket part 1320 engages and pushes the edges of the sheet against the casket part on the casket part exterior 1332 perimeter.

Positive air pressure is applied to the box interior 1305 causing the sheet 1400 to conform even further to the casket part 1320. Simultaneously, the fixture 1313 holding the casket part 1320 draws a vacuum to the interior 1311 of the casket part 1320. This causes the sheet 1400 to curl 1480 around the terminal edge 1322 of the casket part 1320. Likewise, the vacuum applied to the casket part 1320 draws any additional air out from between the casket part 1320 and the adjacent sheet 1400. The resulting combination is positive pressure on the box interior 1305, a sheet 1400 conformed to the casket part exterior 1332, the casket part 1320, a vacuum applied to the casket part interior 1311, and a fixture 1313 for holding the casket part 1320.

Unlike a traditional thermoforming process, in trap forming, the sheet 1400 curls 1480 around the terminal edge 1322 of the casket part 1320. FIG. 15*b* illustrates this in a perspective view. The excess 1490 of the sheet 1400 can then be trimmed off leaving a clean edge that is unseen to the end user. T he trap forming process described above can be particularly useful to apply an image to a casket part made from any material including wood or a metal such as steel.

As shown in FIG. 13*d*, placement of the multi-layer film 1400 into the mold cavity 1310 occurs such that the multi-layer film 1400 comprises semi-curled 1480 terminal ends to ensure the multi-layer film 1400 completely covers the entire exterior 1332 of the molded casket piece to prevent one from discerning the distinction between the film 1400 and the base plastic 1332. Stated differently, in one embodiment, the multi-layer film terminal end wraps around at least a portion of the terminal end 1322 of the casket part 1320. Such embodiment advantageously provides greater holding power of the film 1400 to the casket part 1320 and provides greater aesthetic appeal. The remaining section 1490 of the film can then be removed.

Figure 16:
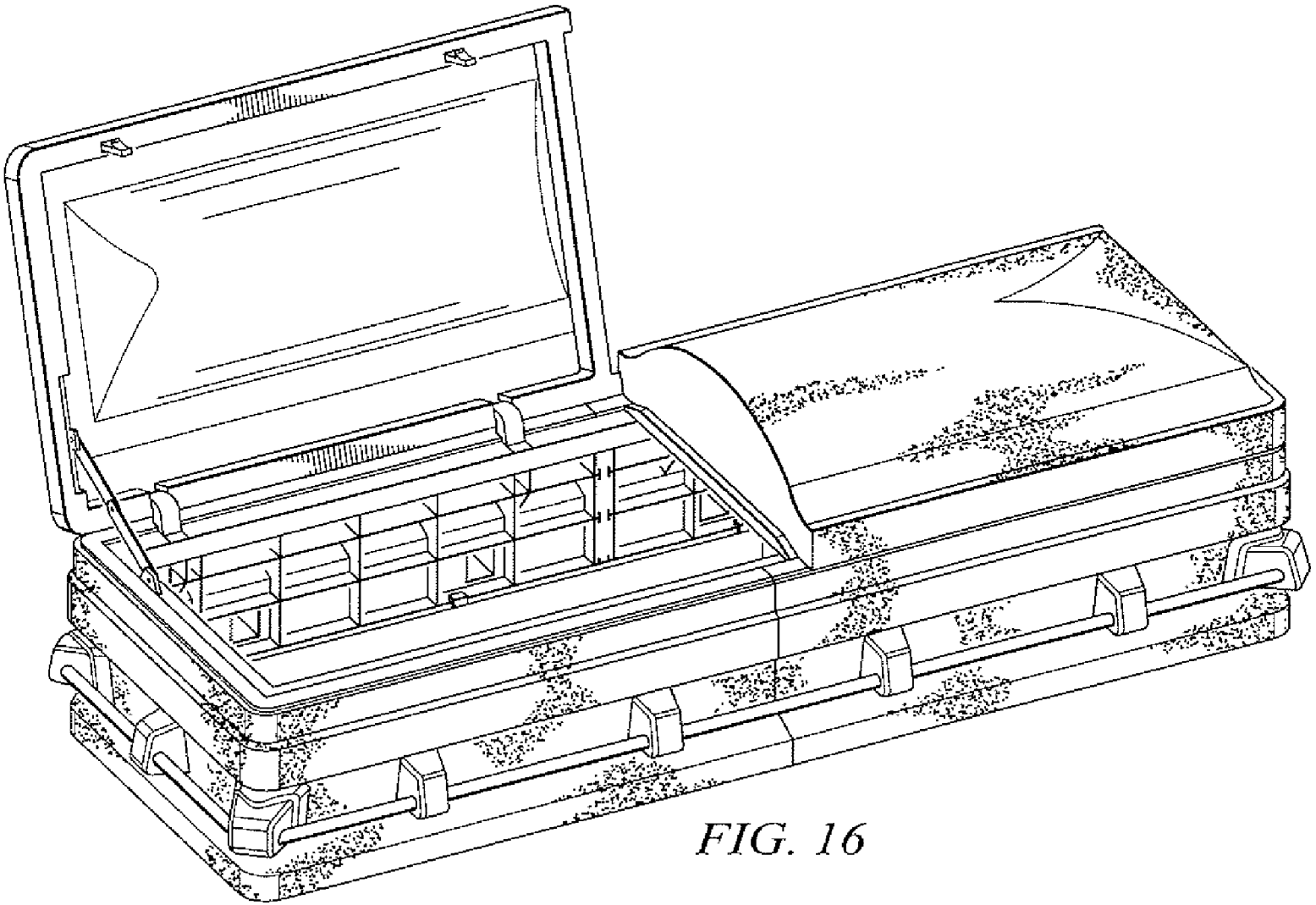
FIG. 16 is a perspective view of a casket attempting to illustrate a stone faux finish in accordance with one embodiment of the present invention.

FIG. 16 is a perspective view of a casket attempting to illustrate a stone faux finish in accordance with one embodiment of the present invention. The image of stone faux finish is provided by the multilayer film. While FIG. 16 is a somewhat crude attempt at showing a casket having a stone faux finish, those skilled in the art, armed with this disclosure, will recognize that the beauty that can be imparted to a casket by a faux stone finish is difficult to overstate. The stone faux finish image can mimic one or more desirable stone images such as granite, marble, limestone, travertine, and breccia. The invention can thereby provide a method for making caskets with a whole new dimension that is not present available. Making a casket out of stone is prohibitively difficult. Further, for all practical purposes, the weight issue alone of a real stone casket forecloses any realistic commercial use. The difficulty and problems associated with the manufacture and shipping of a real stone casket further forecloses any realistic commercial use. Consequently, one embodiment of the present invention provides a method for making a modular casket having pieces which resemble stone, yet weigh just a tiny fraction of the weight of stone itself Thus, the present invention provides a way to have a sophisticated, elegant stone finish applied to a casket.

In one embodiment, the image comprises one or more patriotic symbols such as a flag, or symbols of the armed forces. In one embodiment, the image mimics a wood finish to less expensively provide the look of a wooden coffin. In one embodiment the image mimics a steel finish to less expensively provide the look of a steel casket. In one embodiment, the image comprises one or more colors to less expensively provide the look of a painted casket.

It should be pointed out that these images can be configured through properly registering the image on the film with the corresponding casket piece such that when the modular casket pieces are assembled into the casket, two or more casket pails reveal a single complementary image in a way similar to that of a jigsaw puzzle. For example, in one embodiment, the present invention can mimic the appearance of a flag-draped casket.

In one embodiment, the image comprises a holographic image. Holographic film laminates are known in the art as exemplified by U.S. Pat. Nos. 4,971,646 and 5,200,253. In one embodiment, the holographic image requires one to focus on the image before the image becomes apparent. In one embodiment, the holographic image is printed onto the thin plastic film by with a metallic ink. In one embodiment, the holographic image is printed by a metallic ink on a thin plastic film. In one embodiment, the holographic images are created by using a laser that permits light to be diffracted in multiple directions giving the viewer the ability to see two images in one location.

In one embodiment, the image comprises one or more lenticular images. As used herein, a lenticular image is defined as an image that shows depth or motion as the viewing angle changes. Lenticular film laminates are known in the art as exemplified by U.S. Pat. No. 6,373,636.

In one embodiment the image comprises one or more two-dimensional or three-dimensional religious symbols such as the Pope John Paul, the Virgin Mary, the Virgin of Guadalupe, a cross, Jesus, etc. A casket having a holographic or lenticular image can impart a special atmosphere to participants to a solemn funeral service when images such as religious images appear on the casket. The present invention thereby provides a way convey symbolic meaning in a tasteful manner during a solemn occasion.

The present invention provides numerous advantages over the prior art. First, the plastic caskets of the present invention are less expensive to fabricate than the traditional wood or steel caskets. Second, the casket can be easily shipped as a more compact set of parts than a traditional wood or steel casket, or a non-modular casket fabricated from other materials. Further, because plastic is lighter than wood or metal, the casket of the present invention is not only less expensive to ship, but easier to handle, both in unassembled and assembled form. Further, the casket can be easily moved and stored.

Third, the casket of the present invention can be quickly and easily constructed and assembled by a funeral home or by an individual with little or no assembly experience. The only tools that may be required include a rubber mallet and a screwdriver. The assembly of the snap-fit and pressure-fit pieces is intuitive in the way in which the pieces are put together. Such advantages can be useful in areas of natural disasters. Such advantage also provides the ability to direct-market the casket to consumers through a phone number or web-site without the added expense of a middle man. Further, the casket can be marketed to consumers through stores by-passing the traditional funeral home and resultant mark-up.

Fourth, the casket is made of materials that is more durable than the prior art caskets. For example, unlike wood, plastic does not swell or deform. Unlike metal, plastic does not rust or dent, Further, when the casket of the present invention is packed, it can be shipped without worry of exposure to the elements. For example, the caskets and casket kits of the present invention can be stored outside with worry of exposure to the elements including, but not limited to temperature, humidity, moisture, blowing sand, etc. Such advantage can be useful in areas of natural disasters. Wood, on the other hand, must be stored in controlled climate conditions. Similarly, metal-type caskets, if subjected to high humidity or moisture conditions, are susceptible to rust, especially if any scratches were made through the painted metal during shipment. Thus, the present invention provides a casket that is more durable under both shipping and storage conditions.

Fifth, the casket can be made to emulate the caskets of wood design or steel designs. For example, a wood grain finish can be imparted into the injection molded plastic. Further, rounded corners used in wood caskets can be provided in plastic caskets of the present invention. Further, the color of the plastic can be easily changed to emulate steel-type colors. Moreover, the casket of the present invention has the same accessories as caskets of the prior art. Consequently, the present invention provides a casket having a similar look and design as prior art caskets with lower costs. Thus, there is little or no stigma attached to using a casket made from less expensive plastic materials of the present invention.

Sixth, the present invention can provide an image that is embedded into the material from which the casket is formed. Further, the present invention can provide an affordable alternative to higher-priced steel or wooden caskets without sacrificing the outward appearance of the casket. In fact, the present invention, by providing a modular casket that looks just like stone but that weighs a tiny fraction of stone, can provide a far superior looking casket than those presently available on the market today. It will now be evident to those skilled in the art that there has been described herein a modular casket or coffin. The terms and expressions employed herein have been used as terms of description and not of limitation; and thus, there is no intent of excluding equivalents, but on the contrary it is intended to cover any and all equivalents that may be employed without departing from the spirit and scope of the invention.

In sums while this invention has been particularly shown and described with reference to a preferred embodiment, it will be understood by those skilled in the art that various changes in form and detail may be made therein without departing from the spirit and scope of the invention.

What is claimed is:

1. A method for making a casket having an integral image, said method comprising the steps of:

a) placing a multi-layer film having an image into a mold cavity, said mold cavity defined by a movable mold and a stationary mold;

b) injecting a molten plastic into said mold cavity to form a casket part of said casket having an exterior such that said exterior is in communication with said multi-layer film;

c) cooling said casket part; and d) removing said casket part from said mold cavity wherein said image resides on said exterior of said casket part.

2. The method of claim 1 wherein said image comprises a stone faux finish.

3. The method of claim 1 wherein said image comprises a holographic image.

4. The method of claim 1 wherein said image comprises a lenticular image.

5. The method of claim 1 wherein said image mimics a wood finish.

6. The method of claim 1 wherein said image mimics a steel finish.

7. The method of claim 1 wherein said image at step a) shows no distortion when said image resides on said exterior of said casket part at step d).

8. The method of claim 1 wherein said image comprises a single complementary image.

9. A method for making a casket having an integral image, said method comprising the step of:

a) supplying a casket part of said casket having an exterior;

b) contouring a film having an image and an adhesive layer to said exterior; and c) adhering said exterior of said casket part to said adhesive layer of said film, wherein said film at step b) wraps around at least a portion of a terminal end of said casket part.

10. The method of claim 9 wherein said casket part comprises a wood casket part.

11. The method of claim 9 wherein said casket part comprises a metal casket part.

12. The method of claim 9 wherein said casket part comprises a plastic casket part.

13. The method of claim 9 wherein said image comprises a stone faux finish.

14. The method of claim 9 wherein said image comprises a holographic image.

15. The method of claim 9 wherein said image comprises a lenticular image.

16. The method of claim 9 wherein said image mimics wood finish.

17. The method of claim 9 wherein said image mimics steel finish.

18. The method of claim 9 wherein said film at step b) comprises a heated film.

19. The method of claim 9 wherein said image shows no distortion when contoured to said exterior.

* * * * *